US006438322B1

(12) United States Patent
Reiker

(10) Patent No.: US 6,438,322 B1
(45) **Date of Patent: *Aug. 20, 2002**

(54) CEILING FAN WITH ATTACHED HEATER AND SECONDARY FAN

(76) Inventor: Kenneth H. Reiker, 269 Country Club Dr., Shalimar, FL (US) 32579

( * ) Notice: Subject to any disclaimer, the term of this patent is extended or adjusted under 35 U.S.C. 154(b) by 0 days.

This patent is subject to a terminal disclaimer.

(21) Appl. No.: 09/439,763

(22) Filed: Nov. 15, 1999

Related U.S. Application Data

(60) Provisional application No. 60/108,686, filed on Nov. 16, 1998.

(51) Int. Cl.[7] ..... F24H 3/00
(52) U.S. Cl. ..... 392/364; 416/5
(58) Field of Search ..... 392/364, 360–363, 392/365–369; 416/5, 95, 175, 120; 165/122, 125, 59

(56) References Cited

U.S. PATENT DOCUMENTS

| | | | | |
|---|---|---|---|---|
| 449,404 A | | 3/1891 | Dewey | |
| 3,223,828 A | | 12/1965 | Mast | |
| 3,458,739 A | | 7/1969 | Zelinski et al. | |
| 3,612,168 A | | 10/1971 | Peterson | |
| 4,508,958 A | | 4/1985 | Kan et al. | |
| 4,694,142 A | * | 9/1987 | Glucksman | 392/360 |
| 4,782,213 A | | 11/1988 | Teal | |
| D320,439 S | | 10/1991 | Harper | |
| 5,077,825 A | | 12/1991 | Monrose | 392/361 |
| D327,315 S | | 6/1992 | Pelonis | D23/355 |
| 5,133,042 A | | 7/1992 | Pelonis | 392/365 |
| 5,259,062 A | | 11/1993 | Pelonis | 392/365 |
| 5,333,235 A | | 7/1994 | Ryder | 392/364 |
| D358,873 S | | 5/1995 | Pelonis | D23/337 |
| 5,425,126 A | | 6/1995 | Lee | 392/364 |
| D381,074 S | | 7/1997 | Pelonis | D23/336 |
| 5,668,920 A | | 9/1997 | Pelonis | 392/361 |
| D404,123 S | | 1/1999 | Pelonis | D23/336 |
| 5,887,785 A | * | 3/1999 | Yilmaz | 237/1 R |
| D423,661 S | | 4/2000 | Pelonis | D23/395 |
| 6,160,956 A | | 12/2000 | Pelonis | 392/361 |
| 6,240,247 B1 | * | 5/2001 | Reiker | 392/364 |
| 6,244,820 B1 | * | 6/2001 | Yilmaz | 416/5 |
| 2002/0021891 A1 | * | 2/2002 | Reiker | 392/364 |

FOREIGN PATENT DOCUMENTS

| | | | |
|---|---|---|---|
| DE | 3814612 A | | 11/1989 |
| JP | 1-123949 | * | 5/1989 |

OTHER PUBLICATIONS

Internet Web Page entitled "Pelonis U.S.A.", Pelonis USA, Ltd., 2000, 7 pages.
"The Fan Book" published by Reston Publishing Company, pps 3–128, copyright 1983.

* cited by examiner

*Primary Examiner*—John A. Jeffery
(74) *Attorney, Agent, or Firm*—Myers & Associates, P.C.; Joel D. Myers

(57) ABSTRACT

A room conditioner provides an essentially uniform temperature within a room upon operation of a motor of a ceiling fan. The motor includes a stator supporting by a ceiling mounted shaft and a rotor supporting a set of fan blades of the ceiling fan for causing air flow upon energization of the motor. A heating element heats air flowing therepast and a secondary fan draws air past the heating element. Heated air flowing from the heating element is mixed with the air flow caused by operation of the set of fan blades to distribute warmed air uniformly throughout the space of the room wherein the room conditioner is located.

57 Claims, 21 Drawing Sheets

CEILING FAN WITH ATTACHED HEATER AND SECONDARY FAN

CROSS REFERENCE TO RELATED APPLICATIONS

The present application discloses information common with and claims priority to a provisional application entitled "STABILIZED AIR TEMPERATURE DISTRIBUTION APPARATUS" filed Nov. 16, 1998 and assigned Ser. No. 60/108,686 and describing an invention made by the present inventor.

BACKGROUND OF THE INVENTION

1. Field of the Invention

The present invention relates to room conditioners and, more particularly, to heaters embodied with ceiling fans for injecting heated air into the airflow generated by the ceiling fan to uniformly maintain a room at a constant comfortable temperature.

2. Description of Related Art

In present forced air heating systems, whether in an office environment or in a residence, a heating element is energized by burning gas, burning coal or electricity. A blower is employed for blowing air across the heating element to force the heated air into a duct system. Entry of the heated air into the duct system generally requires a change in direction of the blown heated air, which change or direction creates resistance to air flow. To channel the heated air through multiple changes of direction within the duct system until it is finally exhausted into respective rooms creates further resistance to the air flow. Louvers, whether fixed or movable, generally cover the duct system outlets in each room. Such louvers further alter the direction of air flow and create resistance to the air flow. The collective sum of resistances to air flow presented by a conventional forced air system requires a blower of significant power to ultimately provide a reasonable flow of air into each room through a louvered outlet.

The louvered outlets may be close to the floor, close to the ceiling or anywhere in between depending upon various construction requirements and other impediments. The outflow of heated air through an outlet close to the floor will create adjacent hot spots for an occupant that renders seating close to the louvered outlet uncomfortable. Heated air flow through a louvered outlet close to the ceiling tends to restrict disbursement of the heated air throughout the room as heated air rises and tends to remain in proximity with the ceiling; thus, there may exist cold spots in parts of the room close to the floor. Finally, certain parts of a room be subjected to a downward blast of hot air that is uncomfortable and limits furniture arrangement to prevent a person from being subjected to such a blast.

Conventional duct work is generally of galvanized sheet material which is an excellent thermal conductor. The duct work will therefore tend to become heated and radiate heat into the adjacent attic or walls. Such radiated heat is lost to the occupants of a residence or office and the heater must have an output of sufficient BTU's (British thermal units) to compensate for these heat losses and yet provide sufficient heat to the rooms of interest.

The change in temperature of the duct work may result in condensation developing on the surface of the duct work and adjacent the louvers at the outlets. Such condensation may flow and seep into the material of the walls of a room and cause discoloration.

If certain rooms or offices are unoccupied, it is bothersome to prevent the heating thereof as the respective louvers must be closed and thereafter reopened. Such closing and reopening is generally considered too bothersome to be done unless the respective room is to be closed for a significant period of time. Thus, rooms which are not occupied will remain heated to the detriment of unnecessary energy usage and expense.

It therefore becomes evident that presently widely used forced air heating systems require large capacity heaters to overcome the thermal losses incurred during delivery of the heated air to each room. Large capacity blowers are required to overcome the flow restrictions presented by the duct system and outlet louvers. The energy consumption resulting from such heaters and blowers without any benefit to the occupants of a residence or office is significant and expensive. Blasts of hot air and poor mixing of the heated air with the ambient air in the space to be heated creates discomfort to the occupants.

SUMMARY OF THE INVENTION

The present invention is directed to a room conditioner for heating and gently recirculating air in a room to maintain the air throughout the room at a pleasant uniform temperature without drafts or blasts of heated air. The room conditioner may have a heating element mounted above the motor of a ceiling fan to heat the air flowing therepast. A secondary fan operated in response to rotation of the rotor of the ceiling fan, draws air upwardly past the heating element. The heated air is mixed with the air caused to flow upwardly by operation of the set of fan blades of the ceiling fan. Under certain circumstances the ceiling fan and the secondary fan may direct the air flow downwardly. The resulting warmed air circulates gently throughout the room to warm the room to a temperature comfortable for a user. All of the heat produced by the heating element is essentially conveyed throughout the room at significant energy cost savings compared to a forced air heating system. When the room is not being used, the ceiling fan and heating element may be turned off to conserve on electrical energy resulting in an attendant cost savings.

It is therefore a primary object of the present invention to provide a room conditioner for efficiently heating and maintaining a room at a temperature comfortable to a user.

Another object of the present invention is to provide energy efficient apparatus for selectively heating a room being used.

Still another object of the present invention is to provide a room conditioner producing high volume low velocity heated air circulating throughout a room.

Yet another object of the present invention is provide a room conditioner embodying a ceiling fan and an associated heating element, which heating element will not increase the operating temperature of the ceiling fan motor.

A further object of the present invention is to provide a room conditioner embodying a motor for rotating the set of blades of a ceiling fan and a secondary fan for drawing air past a heating element to mix the heated air with the surrounding air flow produced by the set of blades of the ceiling fan.

A still further object of the present invention is to provide a room conditioner having a common housing for a ceiling fan motor, a secondary fan, and a heating element for heating the air flowing therepast in response to the secondary fan.

A yet further object of the present invention is to provide a room conditioner capable of introducing a flow of heated air with a heater and for cooling a room when the heater is not energized.

A yet further object of the present invention is to provide a method for uniformly and efficiently heating a room.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
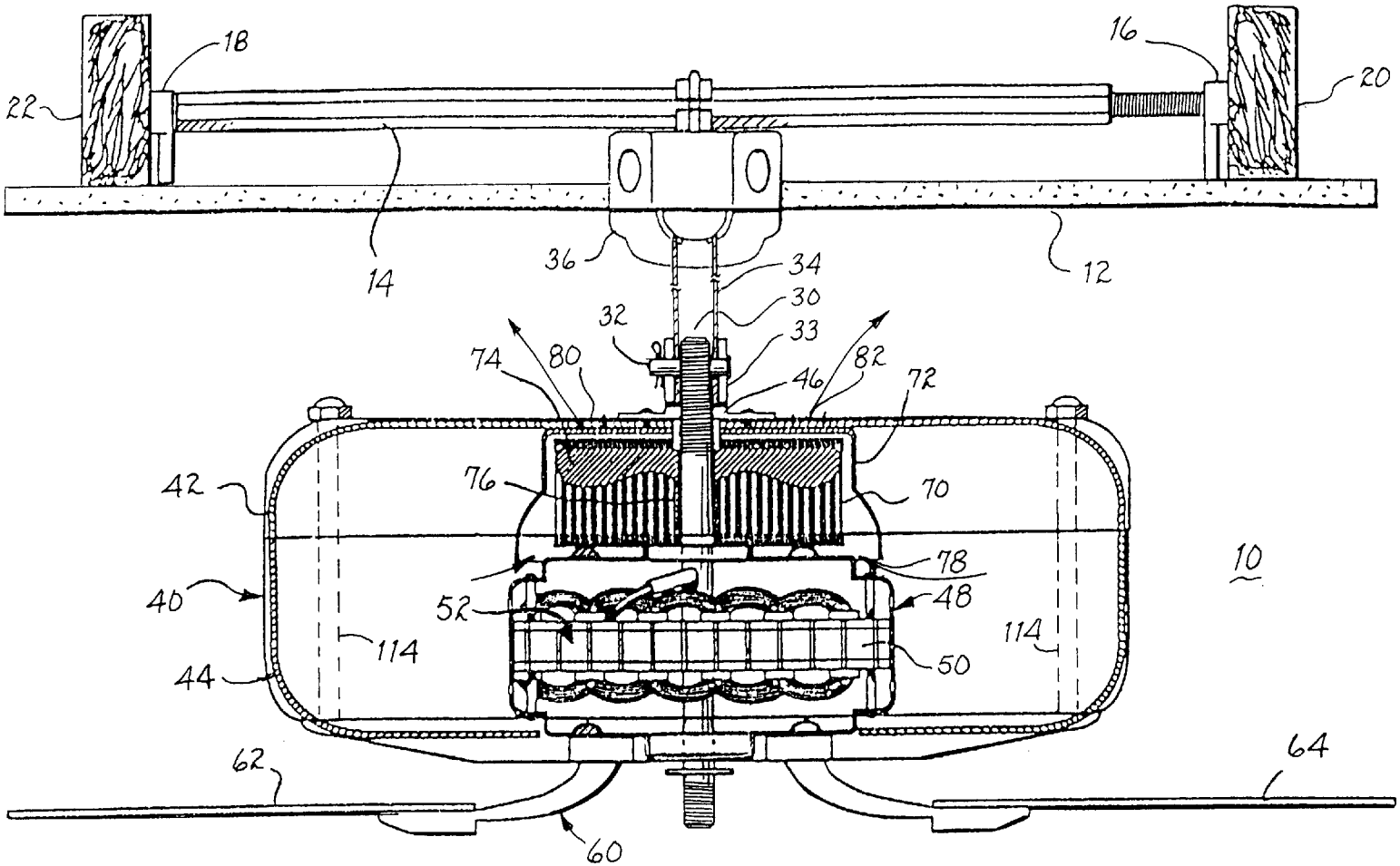
FIG. 1 is a representative cross-sectional view of a room conditioner suspended from a brace mounted intermediate studs of a ceiling.

Referring to FIG. 1, there is illustrated in cross-section a room conditioner 10 suspended below a ceiling 12 from a brace 14 having opposed ends 16, 18 supported by studs 20, 22. The room conditioner includes a depending shaft 30 pinned by pin 32 through a fixture 33 to a sleeve 34 depending from a mounting 36 secured to brace 14, A housing 40, including an upper part 42 and lower part 44, is attached to a plate 46 in threaded engagement with the upper end of shaft 30. Housing 40 may be of electrically insulating material for safety reasons. The material may also be thermally insulative to prevent heating of a surrounding enclosure to afford limitless selection of material for such enclosure. Appropriate locking mechanism may be employed to prevent rotation of the housing relative to the shaft. A casing 48 is rotatably mounted upon shaft 30 and is secured to rotor 50 of electric motor 52. The stator (not shown) of the electric motor is fixedly attached to shaft 30. A set of fan blades 60, of which blades 62, 64 are shown, is fixedly attached to casing 48. Thereby, rotation of rotor 50 will result in rotation of the casing and consequent rotation of set of fan blades 60. A cylindrically configured heating element 70 is fixedly attached to upper housing 42 and is disposed within a depending shroud 72. A secondary fan 74 extends from a sleeve 76 rotatably mounted about shaft 30 and fixedly attached to casino 48. Thereby, rotation of casing 48 will produce commensurate rotation of fan 74. Rotation of fan 74 will draw air upwardly through the lower open end 78 of shroud 72 past heating element 70 and discharge the heated air through apertures 80 extending through the upper part of shroud 72 and upper housing 42. The exhausted heated air will mix with the upwardly flowing, air flow produced by set of fan blades 60 and be dispersed in a temperature uniform manner throughout the space of the room within which room conditioner 10 is mounted.

Figure 2:
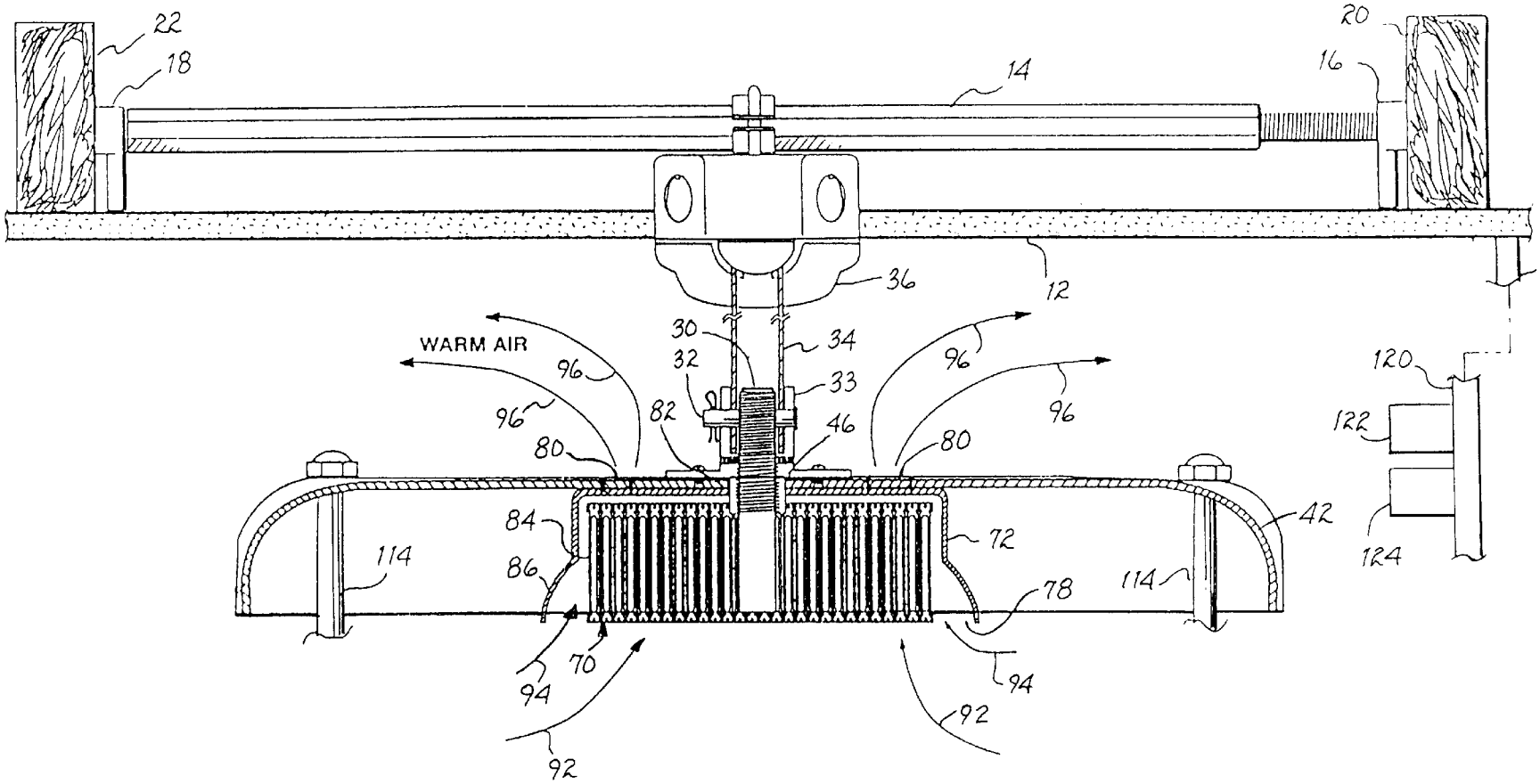
FIG. 2 is a cross-sectional view of the upper half of the room conditioner shown in FIG. 1.
Figure 3:
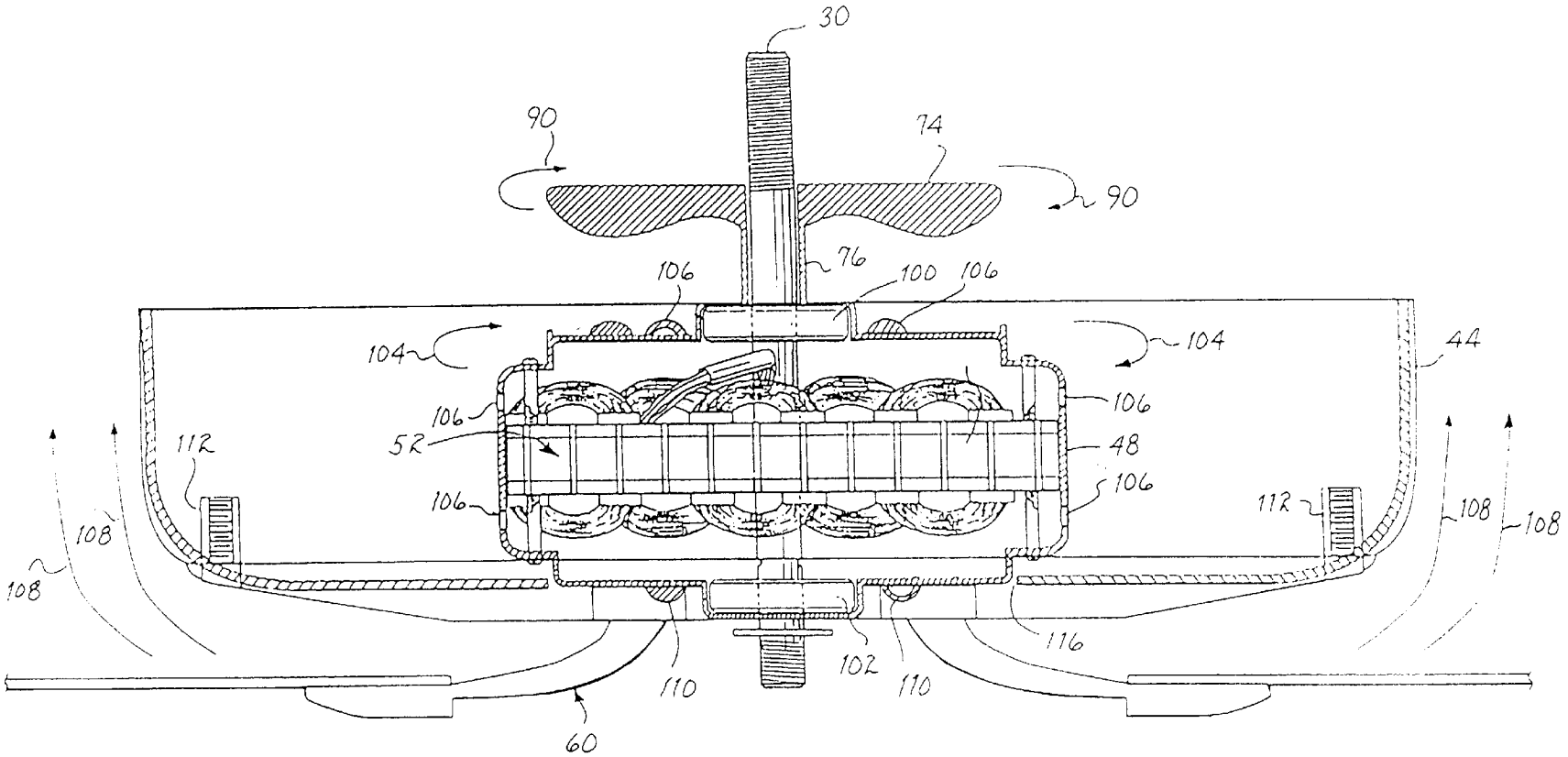
FIG. 3 is a cross-sectional view of the bottom half of the room conditioner shown in FIG. 1.

Referring jointly to FIGS. 2 and 3, further details of room conditioner 10 will be described. Heating element 70 is annular and includes cross-braces (not shown) disposed at the upper end and extending radially from a hub, which hub is fixedly attached to a threaded collar 82 in threaded engagement with shaft 30. Thereby, heating element 70 is concentrically mounted about the shaft. Cylindrical sidewall 84 of the heater includes a plurality of longitudinally extending heating elements responsive to a source of electricity (not shown) and spaced apart from one another to permit air flow through slots therebetween. Heating elements of this type are readily commercially available from various sources. Shroud 72 may include a radially expanded lower part 86 to enhance air flow thereinto. Secondary fan 74 is fixedly attached to casing 48 by sleeve 76 attached to and extending upwardly from the casing. Rotation of the fan, as depicted by arrows 90, will draw air into the interior of heating element 70, as depicted by arrows 92, and into the space intermediate shroud 72 and heating element 70, as depicted by arrows 94. As the air flows through slotted sidewall 84 and within the heating element, the air is subjected to conductive and radiant heat from the heating element and is thereby heated. The heated air exhausts through apertures 80, as depicted by arrows 96.

Casing 48, enclosing motor 52, is journaled upon shaft 30 by bearings 100 and 102 whereby the casing is free to rotate about the shaft, as depicted by arrows 104. Preferably, all or part of casing 48 ma) be of thermally insulative material, including non-metallic and dielectric materials, to prevent migration of heat from heating element 70 to motor 52 and consequent damage to the motor. To assist in cooling motor 50, vents 106 may be disposed in the cylindrical segment of casing 48, as illustrated. Forced air cooling of motor 52 may be accomplished by incorporating scoops 110 at the bottom of casing 48 to capture air as casing 48 rotates and directs the captured air into the casing. Similar but reverse oriented scoops 106 are disposed in the top of casing 48 to encourage exhausting of the air. Thereby, a positive air flow through casing 48 for purposes of cooling motor 52 is accomplished whenever the casing rotates as a result of energization of the motor. The air exhausted from casino 48, being partially warned, flows into to the interior of heating element 70 and will become further heated thereby.

Lower housing 44 may include a plurality of threaded studs 112 for threadedly receiving bolts 114 extending downwardly from upper housing 42. Through such threaded engagement, a means is provided for securing the upper and lower housings to one another. Set of blades 60 is attached to casing 48 in the conventional manner. The bottom surface of lower housing 44 may include an aperture 116 to permit protrusion of all or part of casing 48. Such aperture may be of sufficient diameter to provide an annular space between the perimeter of the aperture and casing 48 to permit a ready flow of air into the housing and to provide a ready source of air to be drawn into and through heating element 70 by fan 74. Alternatively, either or both the upper and lower housings may include apertures in the sidewalls thereof to provide sufficient air flow into the housing.

By having set of blades 60 rotate in a direction to direct air upwardly, as depicted by arrows 108, the upwardly flowing air will mix with the warmed air exhausted from the upper part of housing 40. The mixing of the ambient temperature air flow with the heated air flow will produce a resulting air flow throughout the room that is at a higher temperature than the initial ambient temperature. By employing a wall 120 mounted thermostat 122 (see FIG. 2) electrically connected (not shown) to the heating element, the temperature can be regulated. Moreover, a switch 124, which may be wall mounted, as shown, electrically connected (not shown) to motor 52 can permit control of the speed and direction of rotation of the motor and hence set of blades 60 and secondary fan 74. Thus, operation of the heating element may be regulated to maintain the air within the room at a temperature preferred by an occupant of the room. A time delay may also be incorporated in or as part of switch 124 to first shut off the heating element and then the motor and for other purposes. Furthermore, upon departure from the room, whether for a short period of time or an extended absence, room conditioner 10 may be shut down by switch 124 to conserve the use of electric power.

Figure 4:
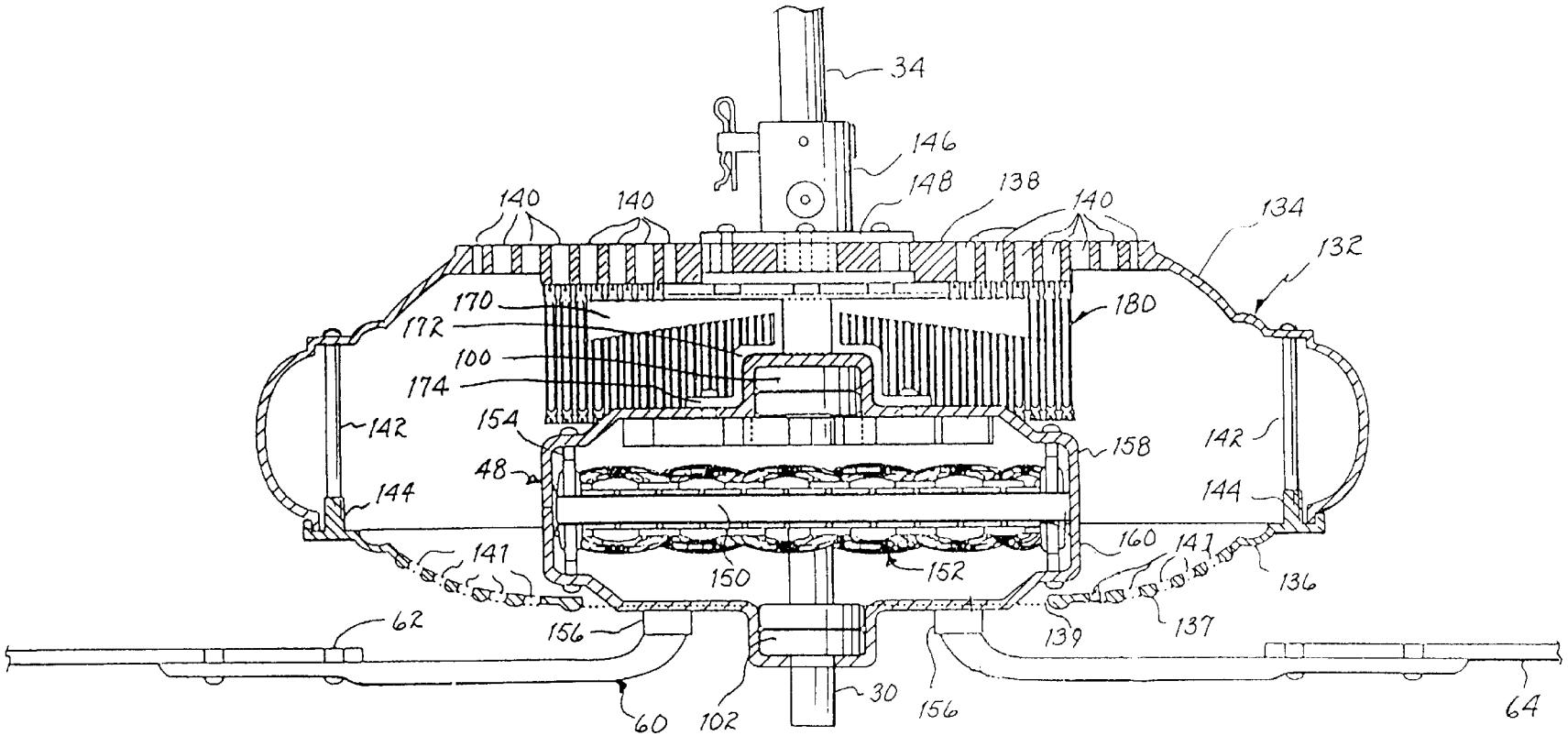
FIG. 4 illustrates a cross-sectional view of a room conditioner embodying the principles of the present invention.

FIG. 4 illustrates a variant 130 of basic room conditioner 10 described above. In particular, variant 130 is related to a commercial embodiment of the present invention. Variant 130 includes a housing 132 having an upper housing 134 and a lower housing 136. Lower housing 136 includes an inwardly extending section 137 defining a central opening by edge 139. The edge is radially displaced outwardly of adjacent casing 48 to provide an air passage therebetween. To enhance air flow into the interior of housing 132, section 137 may include a plurality of apertures 141, whether circular, elongated or other shape. The upper housing includes a concentric circular section 138 having a plurality of apertures 140 extending therethrough for purposes of ventilation. Bottom housing 136 is secured to upper housing through bolts 142 threadedly engaging studs 144. A fixture 146 is pinned to sleeve 34 dependingly secured proximate the ceiling of a room wherein room conditioner 130 is located. Means, such as plate 148, is secured to fixture 146 and retains section 138 to support housing 132. Shaft 30, depending from fixture 146, rotatably supports casing 48 via bearings 100, 102; these may be single bearings or dual bearings, as illustrated. The casing may be attached to rotor 150 of motor 152 by bolts 154, which bolts also secure the upper and lower parts of the casing to one another. The stator of motor 152 is fixedly attached to shaft 130. Thereby, casing 48 will rotate upon energization of the electric motor. Set of fan blades 60, of which blades 62, 64 are shown, is attached to casing 148 through brackets 156, which brackets are of a conventional type. Thereby, set of blades 60 will rotate upon rotational movement of the rotor of electric motor 152.

Further details of variant 130 of a room conditioner will be described with joint reference to FIG. 5, FIGS. 6A and 6B, FIGS. 7A and 7B, FIG. 8, and FIG. 9. Casing 48 includes an upper casing 158 and a lower casing 160 secured to one another by bolts 154 engaging threaded receivers. A plurality of apertures 162 may be disposed in lower casing 160 to assist in providing ventilation for motor 152. To induce ventilation of the casing and consequent air flow in and about electric motor 152, a fan 164, in the nature of a plurality of radial flanges or fins 166 may be secured to the interior upper surface of upper casing 158, as illustrated. Upon rotation of casing 48, fan 164 will rotate relative to the air within the casing. Such rotation will urge radial air flow along the outwardly flanges and downwardly along the interior surfaces of the casing with a corresponding drawing of air around and about shaft 130 and through motor 152. Further more, fan 164 serves in the manner of a heat sink. A secondary fan 170 is secured to upper casing 158 by a support structure 172 having an annular flange 174 bolted (as illustrated in FIG. 4), riveted, or by other securing means to upper casing 158. As particularly shown in FIG. 8, fan 170 includes a plurality of blades 176 extending radially from a hub 177 and a sleeve 178, which sleeve circumscribes shaft 30. These blades may have an air foil cross-section, be twisted radially or simply be angled flat plates.

Figure 5:
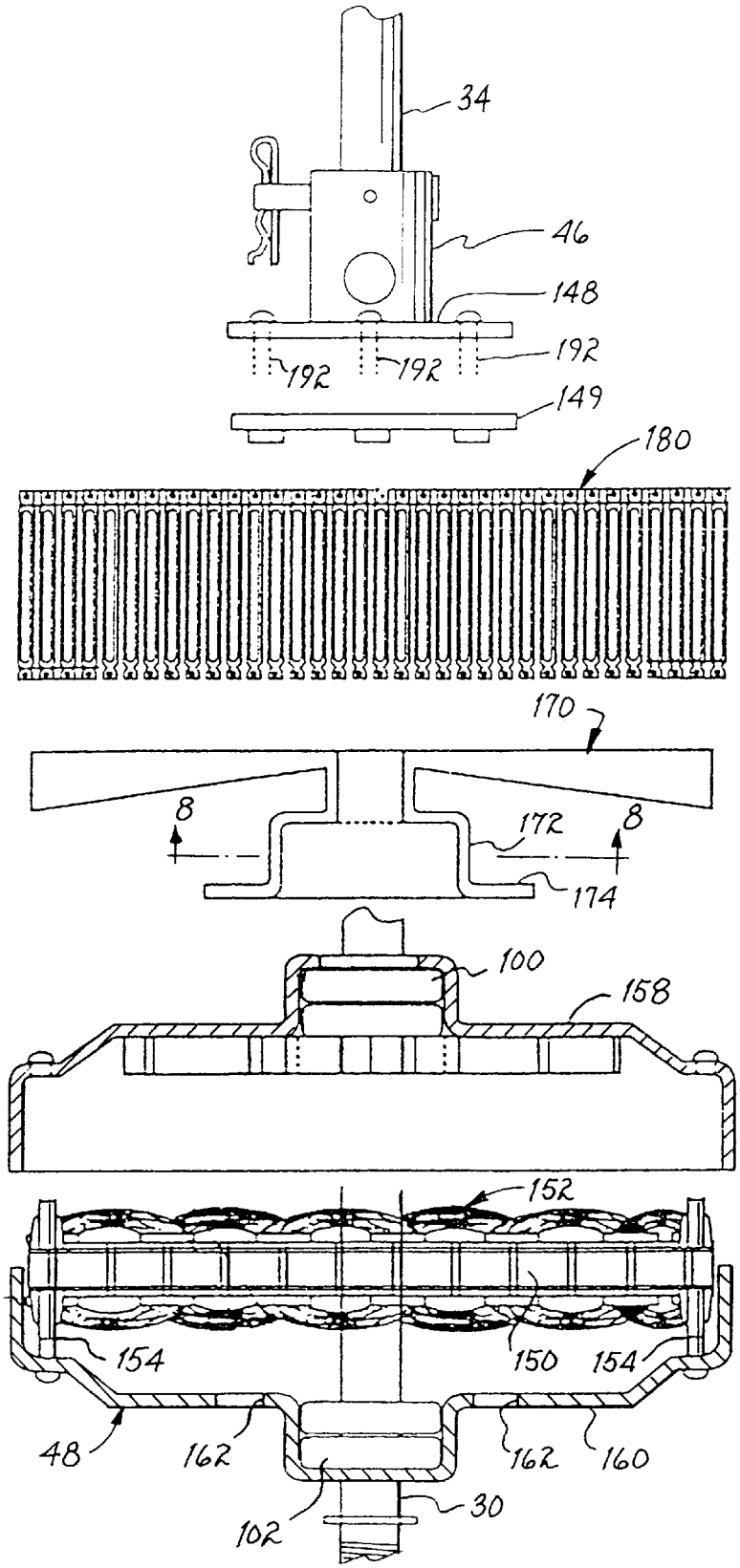
FIG. 5 is an exploded view of certain components of the room conditioner illustrated in FIG. 4.
Figure 7B:
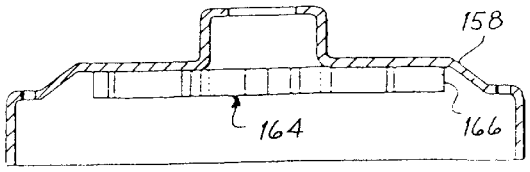
FIG. 7A and 7B illustrate a top view and a cross-sectional view, respectively, of the upper motor casing shown in FIG. 5.
Figure 6B:
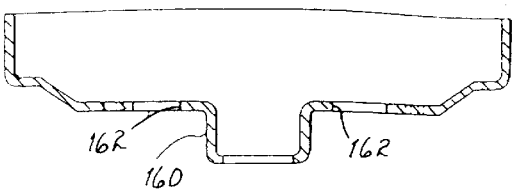
FIGS. 6A and 6B illustrate a bottom view and cross-sectional view, respectively, of the lower motor casing shown in FIG. 5.
Figure 7A:
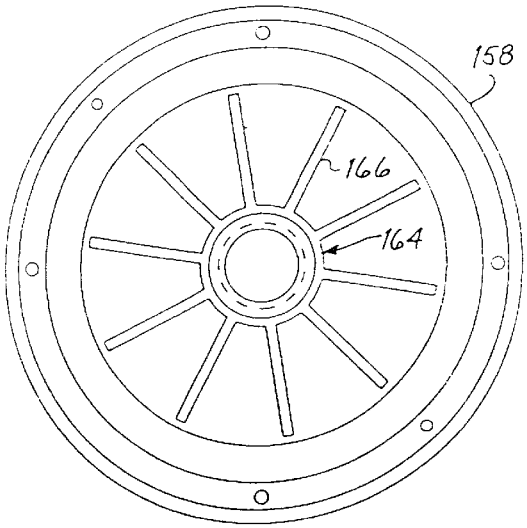
Figure 6A:
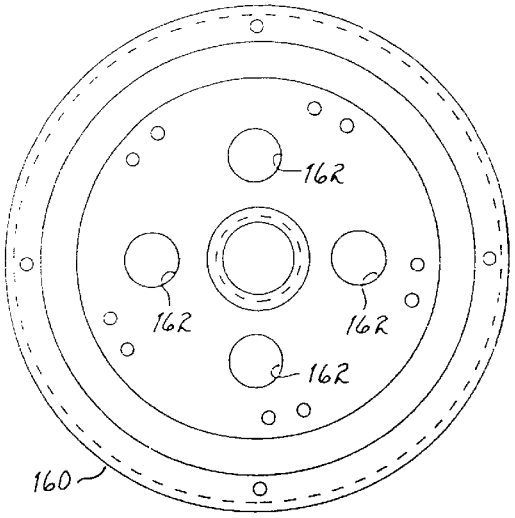
Figure 8:
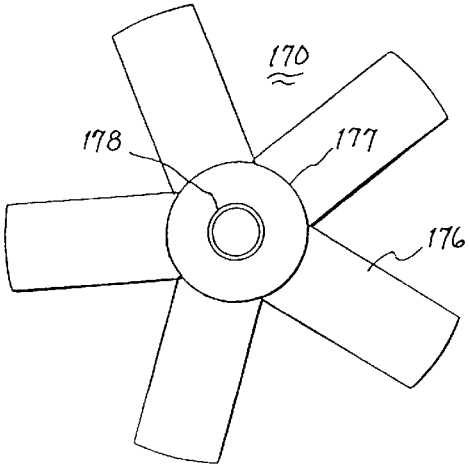
FIG. 8 shows a top view of a secondary fan shown in FIG. 5.
Figure 9:
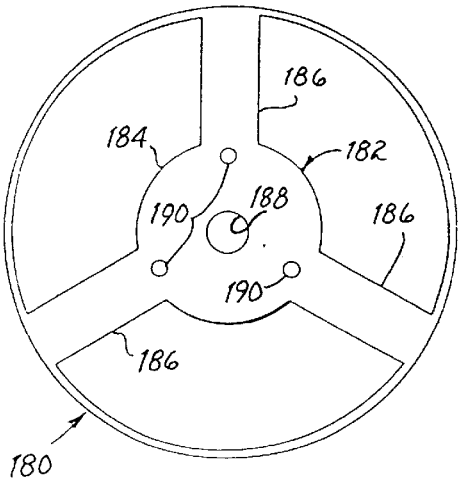
FIG. 9 shows a top view of the heating element shown in FIG. 5.

A heating element 180 is cylindrical, as illustrated in FIGS. 5 and 9. A support structure 182 extends across the top of the heating element and may include a hub 184 with three legs 186 extending therefrom into engagement with the top edge of the heating element. The hub is centrally apertured with aperture 188 to accommodate passage therethrough of shaft 30. Holes 190 are disposed in the hub to accommodate pass through of bolts extending downwardly from plate 148 to retain the support structure adjacent the internal surface of section 138 of upper housing 134, as shown in FIG. 4. A backing plate 149 may be used to engage bolts 192. The relative locations of fan 170 and heating element 180 positions the fan within and proximate the upper end of the heating element, as shown in FIG. 4.

Figure 10:
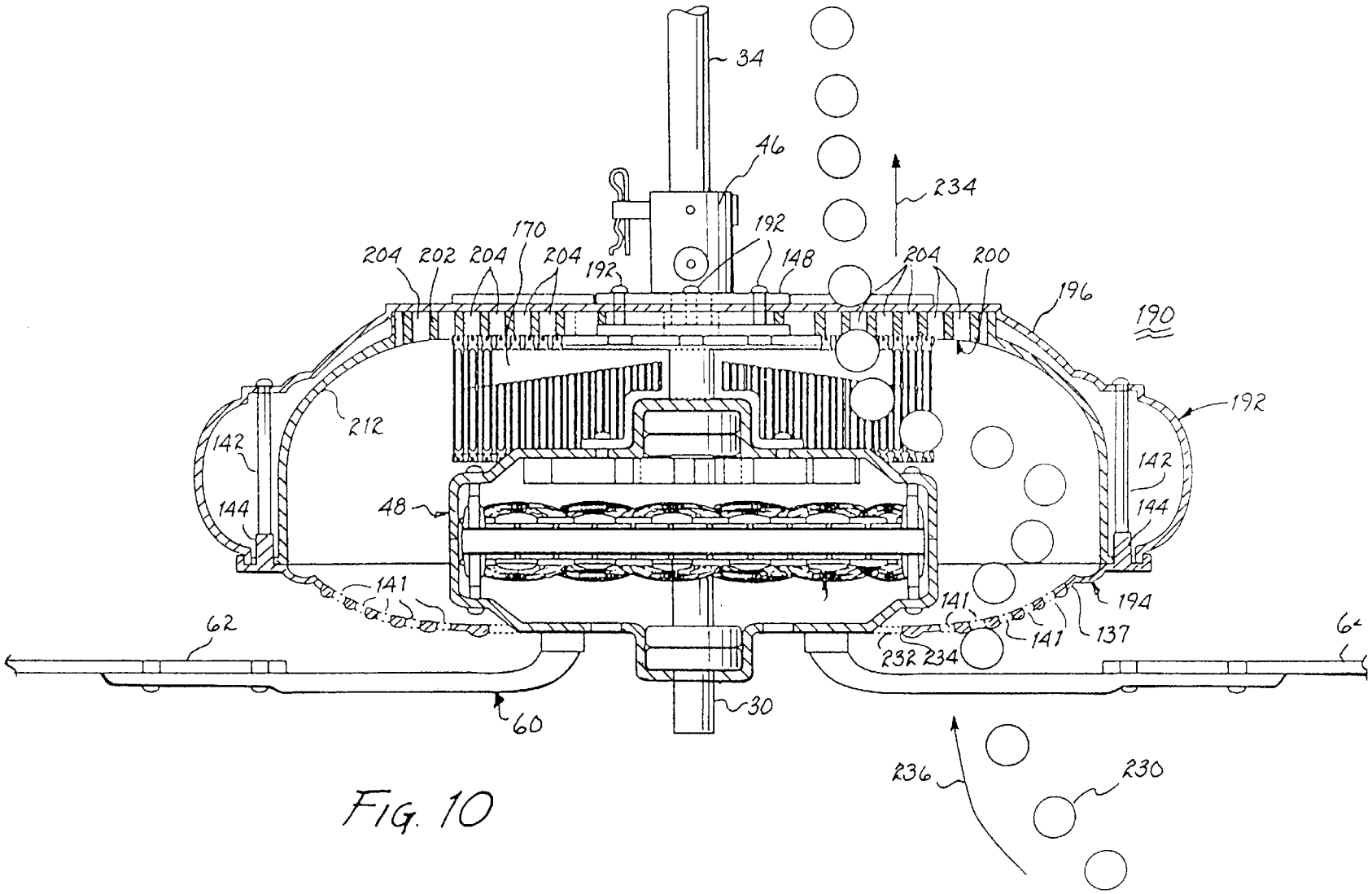
FIG. 10 illustrates a commercially viable room conditioner.
Figure 11B:
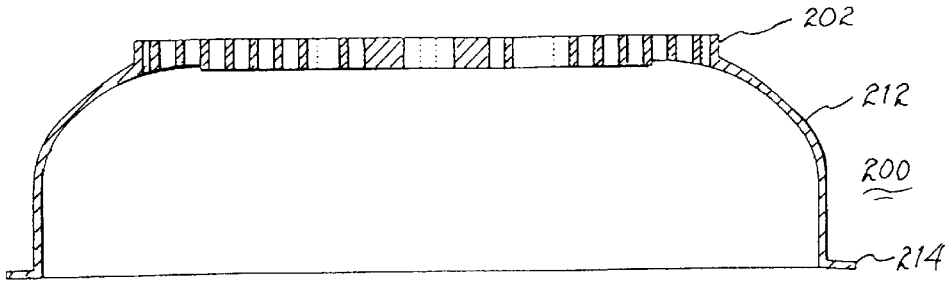
FIGS. 11A and 11B illustrate a top view and a side view, respectively, of a shroud illustrated in FIG. 10.
Figure 11A:
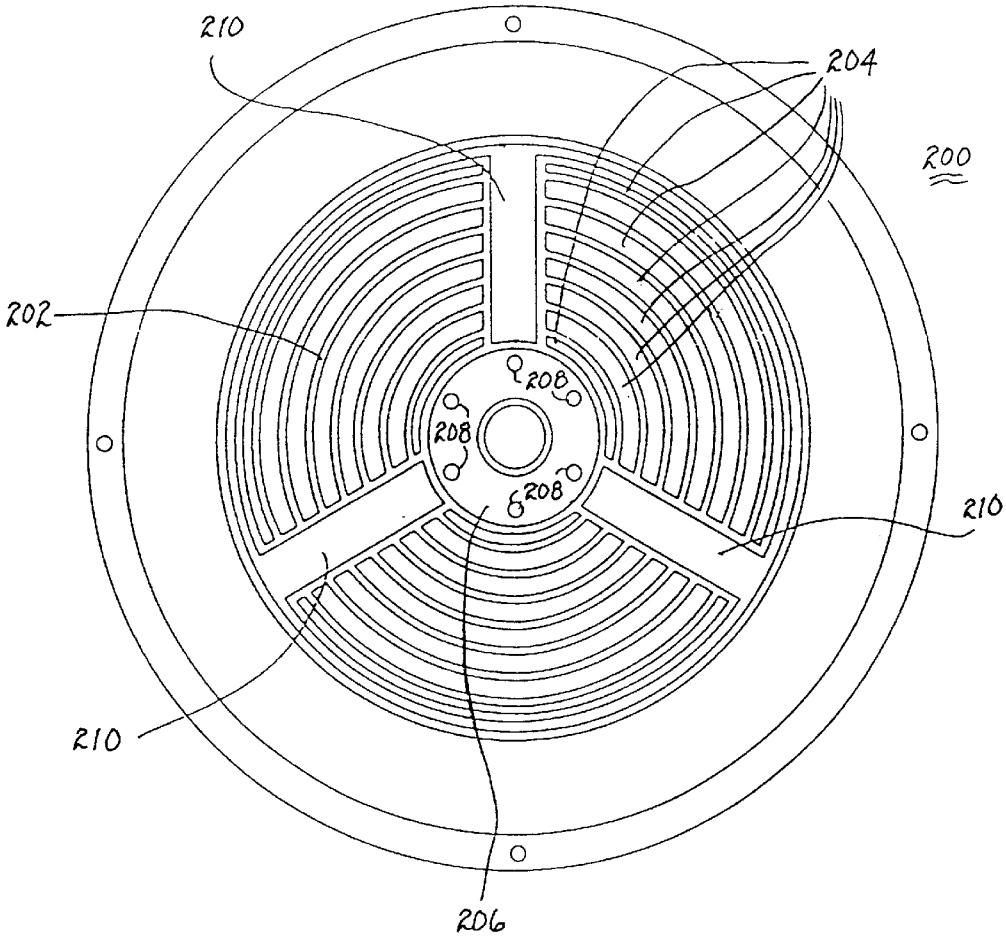
Figure 12:
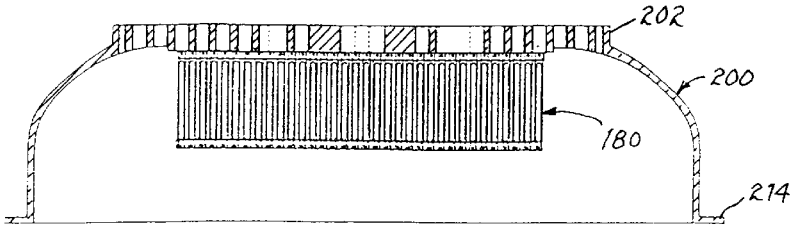
FIG. 12 illustrates a side view of the heating element mounted within a shroud.
Figure 13:
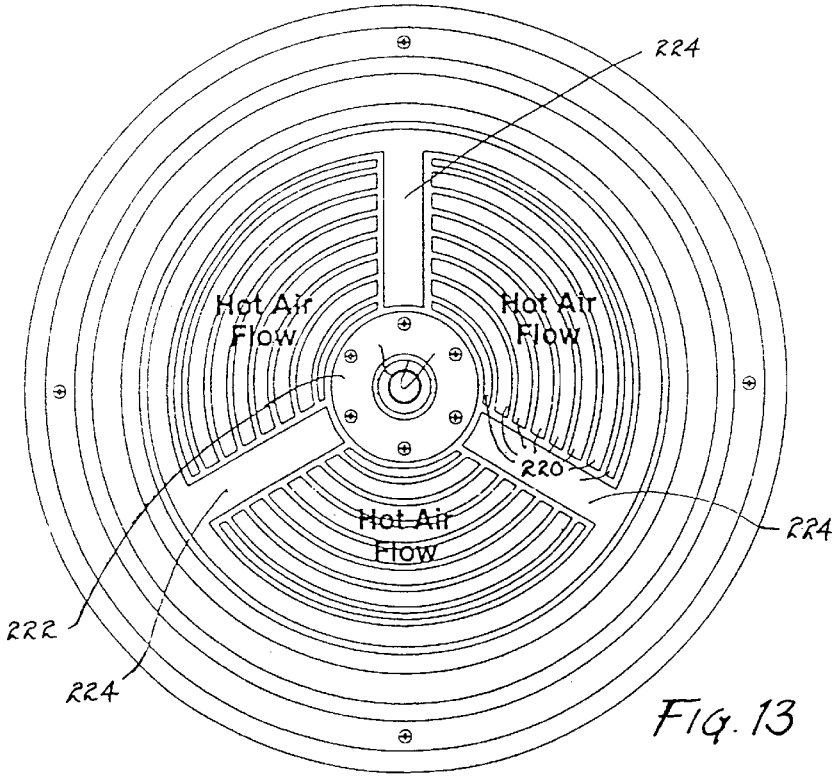
FIG. 13 illustrates a top view of the upper housing for the room conditioner, shown in FIG. 10.
Figure 14:
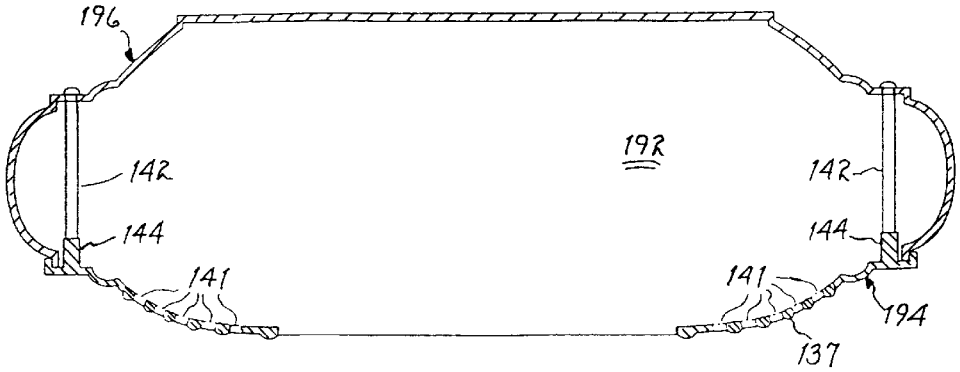
FIG. 14 illustrates a side view of the upper and lower housings for the room conditioner shown in FIG. 10.

Referring to FIG. 10, there is shown a variant 190 of a room conditioner which is very similar to variant 130 shown in FIG. 4. To describe the differences between variant 130 and variant 190 of the room conditioner, joint reference also will be made to FIGS. 11A, 11B, 12, 13 and 14. Housing 192 includes a lower housing 194 similar with lower housing 136 shown in FIG. 4. Lower housing 194 includes a section 137 having apertures 141 formed therein for ventilation purposes. It also includes threaded studs 144 for receiving bolts 142 to join lower housing 194 with upper housing 196. Neither upper nor lower housings of housing 192 serves a support function for any components; hence, the material of the housing may be dictated primarily by decorative considerations and may be made of metal, plastic or, glass or components of the housing may have elements of these materials. Structural rigidity for the room conditioner is provided by internal shroud 200, depicted in further detail in FIGS. 11A and 11B. Shroud 200, or parts thereof, may be of thermally insulative material to prevent damaging heat radiation to the surrounding housing. Thereby, the material of the housing, such as housing 192, may be of any type of material dictated only by aesthetic considerations. The shroud includes a structural platform 202 of generally planar circular configuration. As particularly illustrated in FIG. 11A, it may include a plurality of concentric arcs 204 to provide for passage of air therethrough. A hub 206 includes a plurality of apertures 208 for penetrably receiving bolts extending from plate 148 secured to fixture 146. A plurality of spokes 210 extend equiangularly from hub 206. As noted in FIG. 11B, platform 202 may have significant thickness to provide the requisite strength and robustness to support heating element 180 depending therefrom, as depicted in FIG. 12. A circular skirt 212 extends radially and downwardly from platform 202 and terminates at a radial flange 214. The skirt serves the primary purpose of directing a flow of air into and through heating element 180. Radial flange 214 engages the junction between upper and lower housings 196, 194 and may be secured thereto by bolts or screws (not shown). As depicted in FIG. 13, upper housing 196 includes a plurality of concentric arc segments 220 extending radially from hub 222. These arc segments positionally correspond with arcs 204 disposed in internal shroud 200, as described above. Additionally, the upper housing includes spokes 224 corresponding with spokes 210 of the internal shroud. Central aperture 226 accommodates passage therethrough of shaft 30.

As depicted in FIG. 10, air molecules 230 are drawn into housing 192 by rotation of secondary fan 170, which fan creates an upward flow of air through the apertures or arcs in platform 202 and the associated section of upper housing 196. The air flow may be through apertures 141 in lower housing 194 as well as through annular space 232 intermediate edge 234 of the central aperture in the lower housing and the corresponding part of casing 48. The curvature of skirt 212 provides a relatively smooth and obstruction free passage to the air molecules to direct them essentially radially through and into heating element 180. These air molecules are heated as they flow past the heating element. Upon being heated, the air molecules rise, as depicted by the stream of air molecules 230 and arrow 234. While only one side of the airflow is depicted, it is to be understood that such air flow occurs all around the vertical axis. It may be noted that the inflow of air molecules into the room conditioner is depicted by arrow 236. As the air molecules flow upwardly above the room conditioner depicted by arrow 234, they are mixed with the upward air flow produced upon rotation of set of fan blades 60, of which fan blades 62, 64 are shown.

Figure 15:
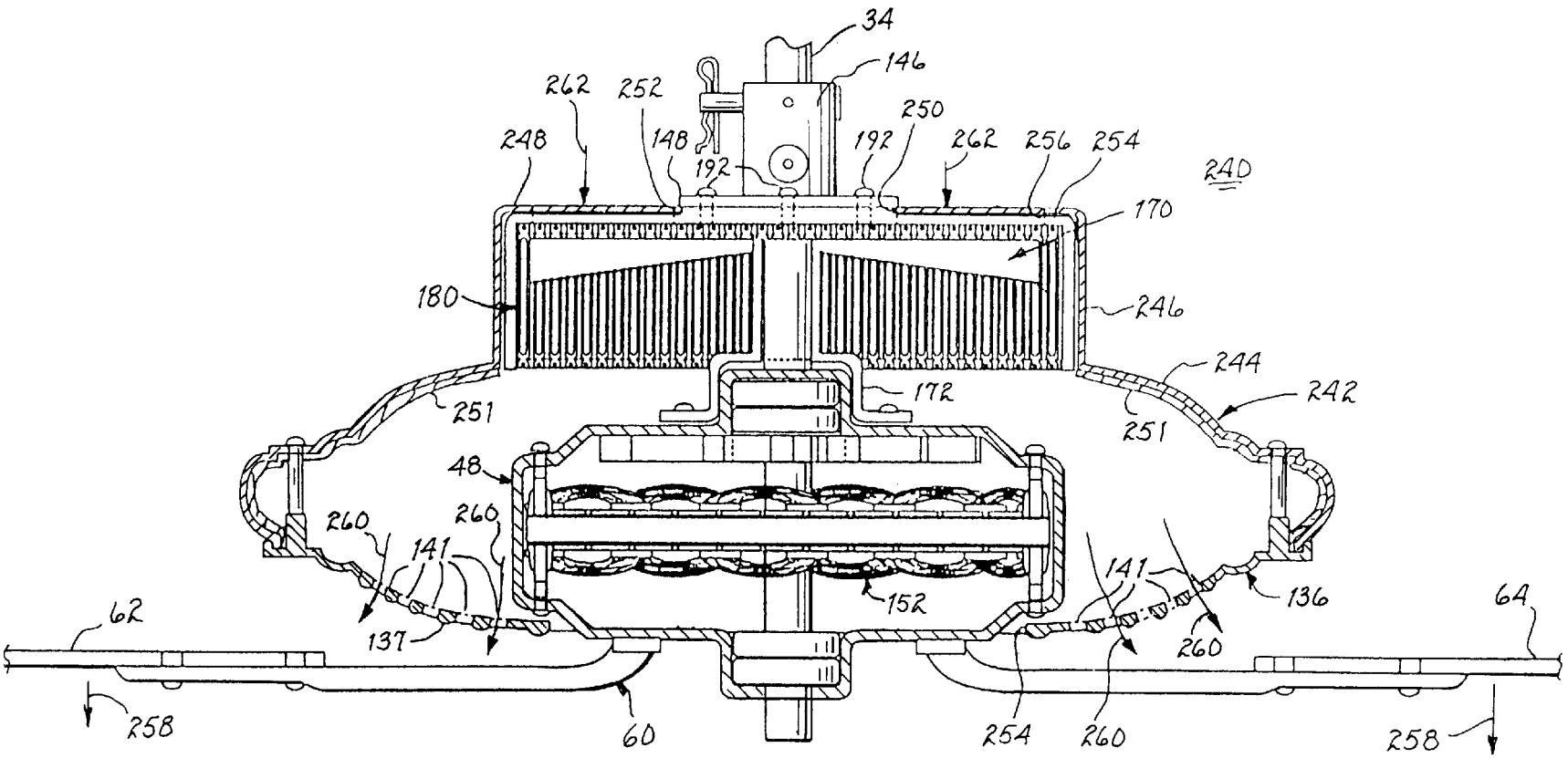
FIG. 15 illustrates a room conditioner having an upwardly displaced heating element.

FIG. 15 illustrates a variant 240 of the room conditioner shown in FIG. 4. Elements discussed below that are common to variant 130 (FIG. 4) will be assigned common reference numerals. Housing 242 includes a lower housing 136 like that shown in FIG. 4. Upper housing 244 includes an upwardly extending cylinder 246 having a top annular element 248 centrally apertured to define aperture 250. A lining 251 of thermally insulative material may be located interior of all or part of housing 242 to permit use of any aesthetically pleasing material for the housing. A plurality of apertures 252, which may be slots or holes of any shape or configuration, are disposed in top element 248. A cylindrical cap 254 is attached to plate 148 by bolts penetrably engaging the plate and the cap to retain the cap attached to fixture 146 and hence to sleeve 34. The cap includes a plurality of apertures 256 commensurate in configuration and location with apertures 252 disposed in top element 248. Accordingly, apertures 252 and 256 permit air flow into and out of cap 254. Heating element 180 is mounted and secured to plate 148, as described above. Secondary fan 170 and attendant support 172 is secured to casing 48 as described above. From the above description of variant 240 it becomes apparent that housing 242 is not a load bearing element and is dependingly supported upon cap 254. Accordingly, it may be of metal, plastic or glass having an aesthetically pleasing design.

If set of blades 60, of which blades 62 and 64 are shown, are caused to rotate by operation of motor 152 to produce a downward flow of air, as depicted by arrows 258, heated air will be drawn downwardly through variant 240. In particular, a low pressure environment will be created proximate the exterior of lower housing 136. The low pressure will cause air from within the housing to flow therefrom through apertures 141, as depicted by arrows 260. The resulting low pressure environment within housing 242 will draw replacement air through apertures 252 and 256 into contact with heating element 180. The air flow through these apertures, as depicted by arrows 262, will be enhanced by secondary fan 170 wherein its blades are configured to urge downward air movement upon rotation in the same direction as set of blades 60. The air flowing past the heating element will be heated by conduction and radiation. The heated air exhausting from housing 242 will be mixed with the downflowing air urged by set of blades 60 and the room will become warmed by the circulation of this mixed air.

If the direction of rotation of set of blades 60 and secondary fan 170 is reversed, the secondary fan will expel air from within the housing 242 through apertures 252, 256. The inflow of air into the housing will be through apertures 141 and through the annular space intermediate edge 254 of lower housing 136 surrounding the lower part of casing 48, as discussed above. Consequently, the air flow depicted by arrows 258, 260 and 262 will be reversed and the heated air exhausting through apertures 252, 256 will be mixed with the upward flow of air caused by set of blades 60.

Figure 16:
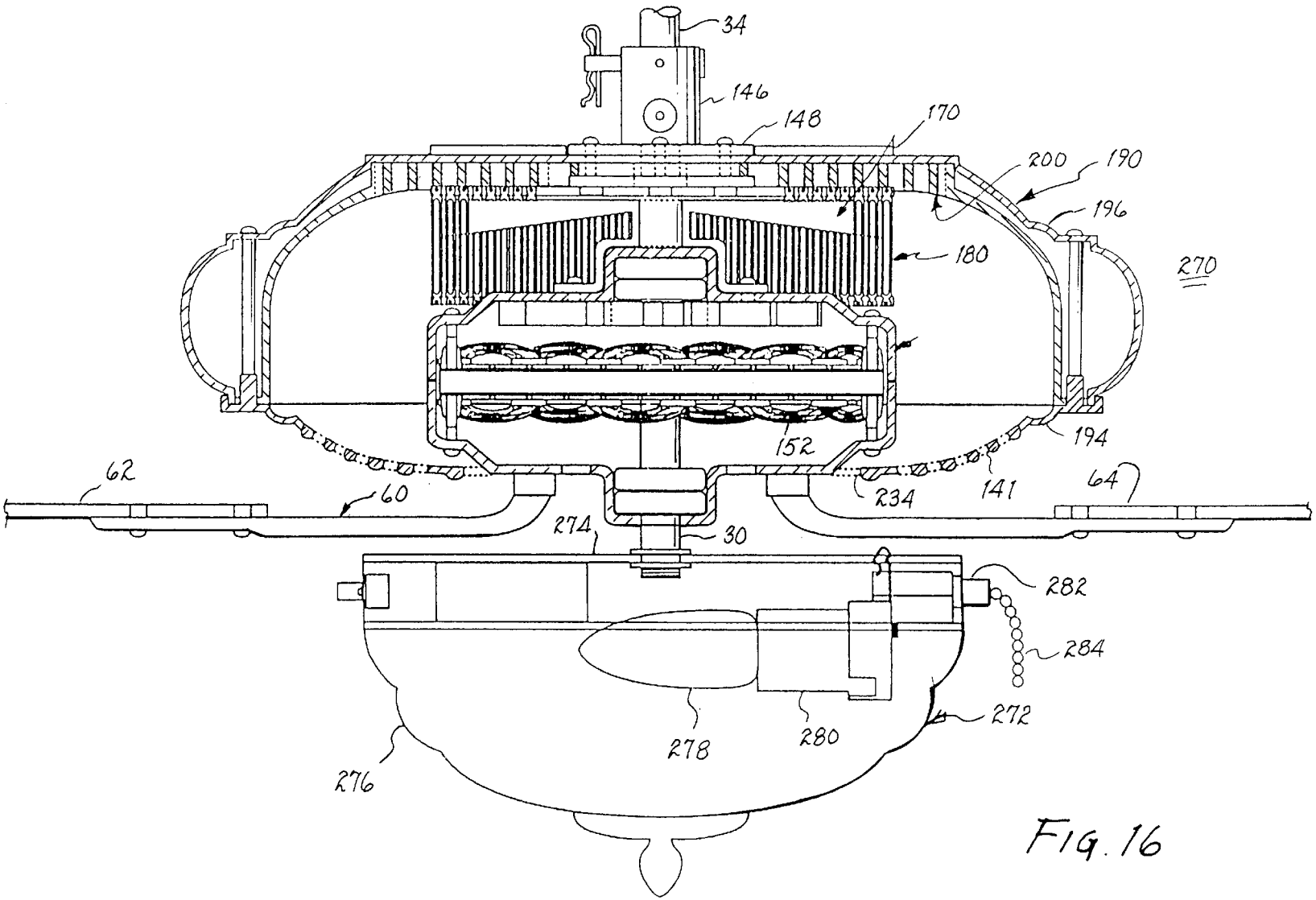
FIG. 16 illustrates a room conditioner shown in FIG. 10 having a light depending therefrom.

Referring to FIG. 16, there is illustrated a variant 270 of a room conditioner, which variant is similar to variant 190 illustrated in FIG. 10. In the description below, elements common with variant 190 will be assigned the same reference numerals. Many ceiling fans provide the dual function of circulating air and providing a source of light. For the latter purpose, variant 270 includes a light fixture 272 having a brace 274 for attachment to shaft 30. Light fixture 272 includes a transparent or translucent bowl 276. The material, configuration, and ornamentation attendant the bowl may be dictated primarily by aesthetic considerations. A light 278 mounted within a receptacle 280 is disposed within the bowl and secured to brace 274 by suitable structure well known to those skilled in the art. An on-off switch 282 having a pull cord 284 depending therefrom may be used to provide selective energization of light 278.

Figure 17:
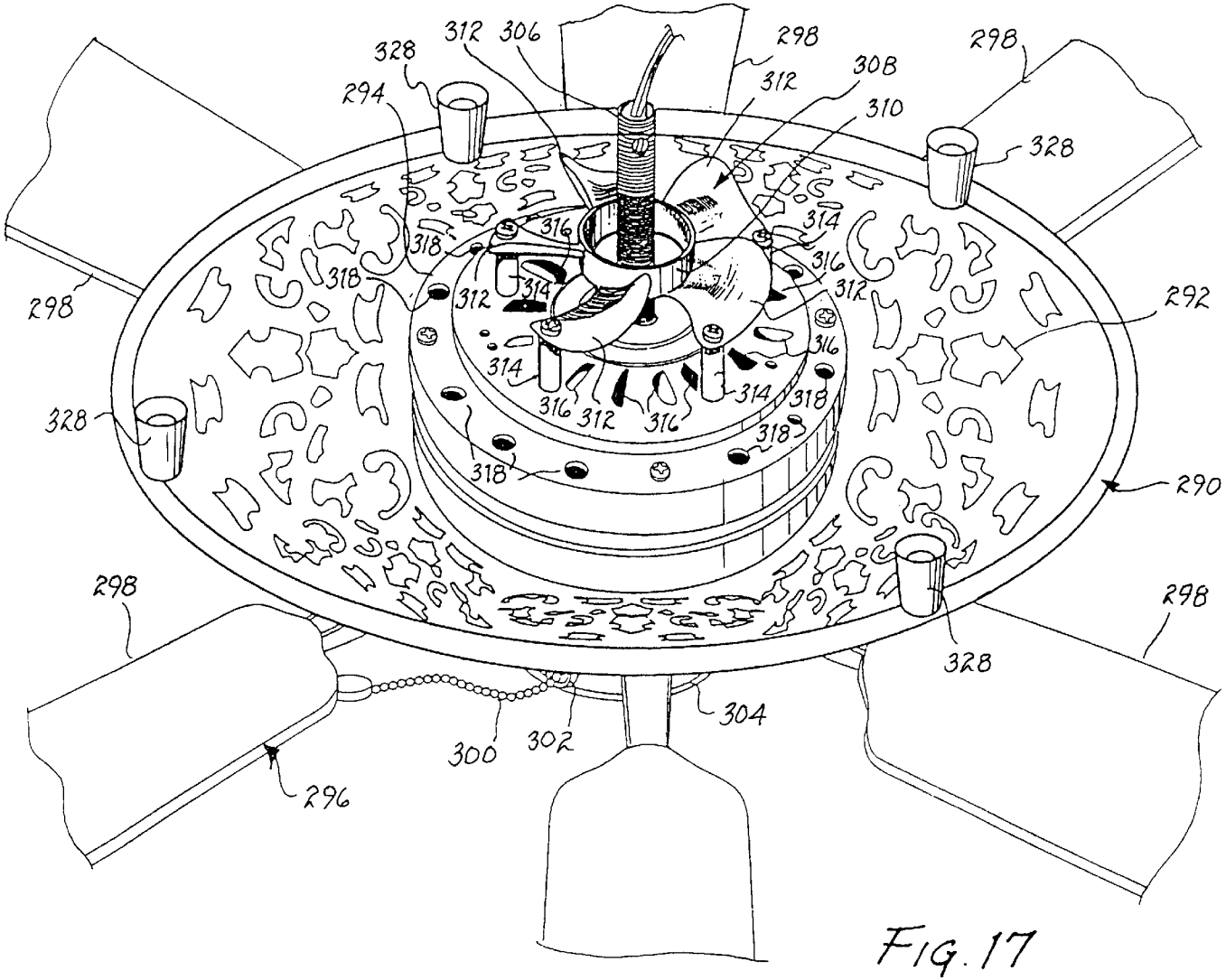
FIG. 17 illustrates the interior of the bottom half of a room conditioner having a casing mounted secondary fan.

FIG. 17 illustrates a lower housing 290 of a ceiling fan and having a plurality of randomly configured apertures 292; alternatively, these apertures may collectively represent a specific design. A casing 294 is located proximate the center bottom of lower housing 290 and houses an electric motor to rotate a set of blades 296, of which six equiangularly oriented blades 298 are illustrated in part. Moreover, a pull cord 300 extends from a switch 302 mounted in a box 304 as shown to regulate operation of the ceiling fan. A non-rotating shaft 306 extends upwardly from casing 294 and has attached thereto the stator of the motor disposed within casing 294. The casing is attached to the rotor of the motor. Accordingly, the casing, and set of blades 296 attached thereto, will rotate upon energization of the motor. Lower housing 290 is secured through its mating upper housing (not shown) to shaft 306 and is a non-rotating element.

A secondary fan 308 includes a hub 310 supporting each of fan blades 312, which hub is not in contacting engagement with shaft 306. Support for fan 308 is provided by each of a plurality of stanchions 314 extending upwardly from casing 294. Thereby, rotation of casing 294 will produce commensurate rotation of fan 308, which rotation will result in a commensurate air flow. For reasons which will become apparent below, casing 294 includes a plurality of vents 316. Further vents 318 may also be embodied.

Figure 18:
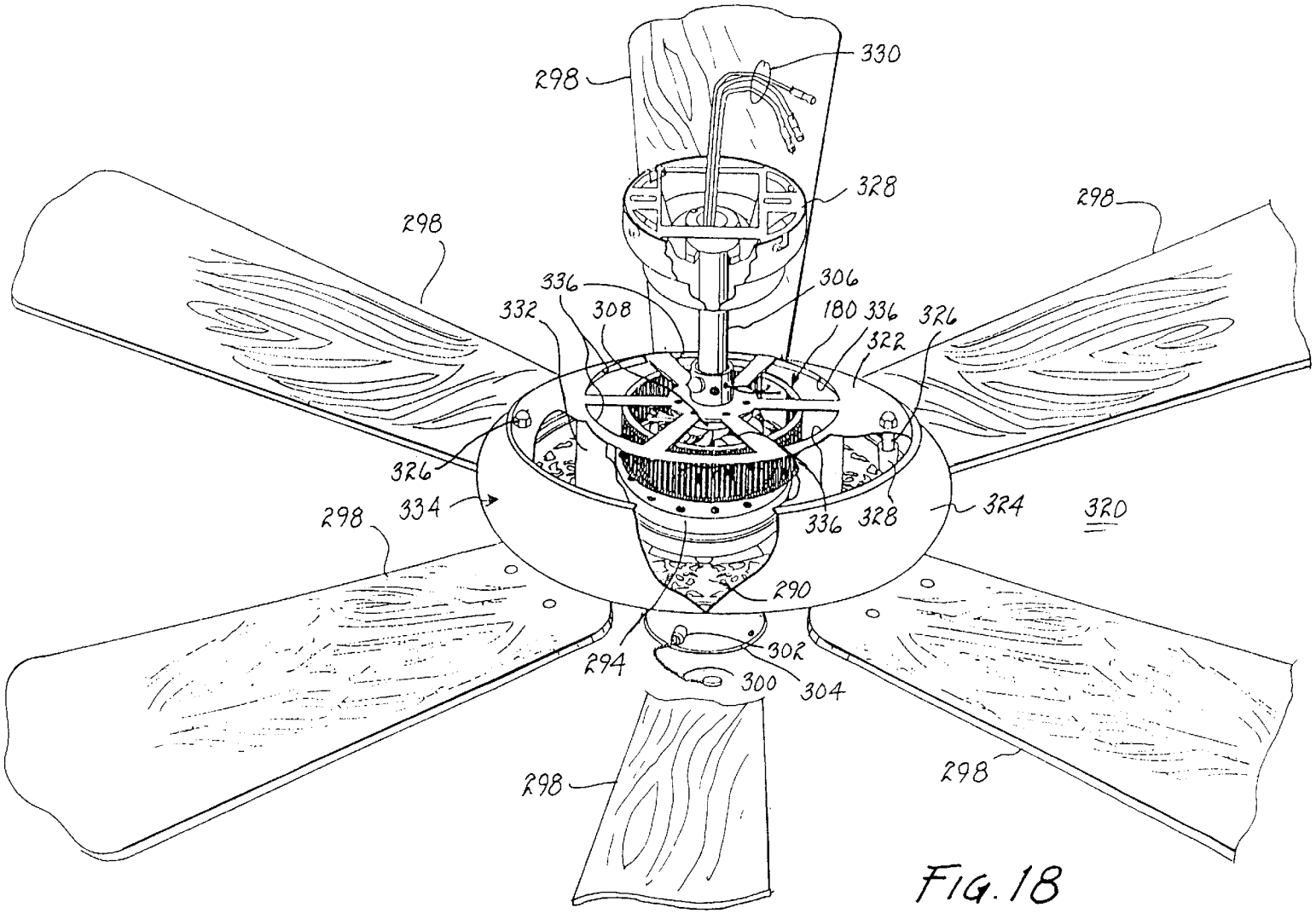
FIG. 18 illustrates a room conditioner incorporating the secondary fan shown in FIG. 17.

FIG. 18 illustrates a variant 320 of a room conditioner embodying the structure shown in FIG. 17 described above. FIG. 18 includes cutaway portions to illustrate various internal components thereof. An upper housing 334, which may include circular sidewall 324, is attached to lower housing 290 by a plurality of bolts 326 engaging receivers 328 extending from the lower housing. A heating element 180, like the heating elements described above, depends from upper housing 322 and circumscribingly encloses fan 308 attached to and extending upwardly from casing 294. A fixture 328 is secured to shaft 306, or an extension thereof, and supports variant 320 from a ceiling or like structure. Electrical conductors 330 extend from fixture 328 for connection to a source of electrical power to operate the motor within casing 294 and heating element 180; these conductors may also be connected to a thermostat to permit control of operation of the heating element. A cylindrical shroud 332 may be disposed within housing 334 formed by lower housing 290, upper housing 322 and cylindrical sidewalls 324 to circumscribe casing 294 and heating element 180. This shroud is preferably radially outside of apertures 336 disposed in upper housing 322. The shroud serves the function of controlling air flow to and from the heating element. Moreover, all or part of housing 334 and particularly shroud 332 may be of thermally insulative material.

Figure 19:
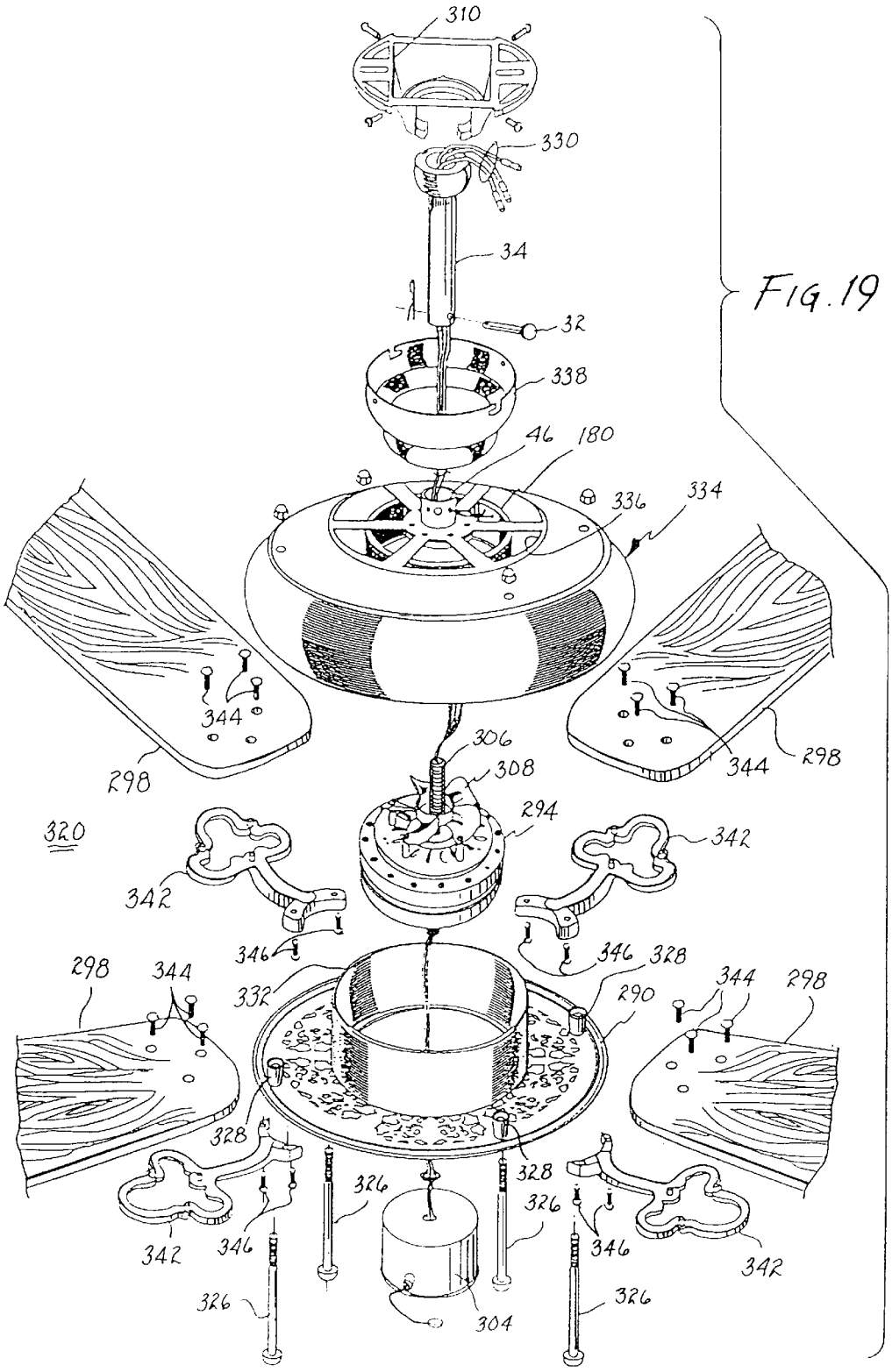
FIG. 19 illustrates an exploded view of the room conditioner shown in FIG. 18.

FIG. 19 is an exploded view of variant 320 of the room conditioner shown in FIG. 18. In addition to the elements described above, fixture 328 (see FIG. 18) is illustrated to include enclosure 338 and support 340. Only four fan blades 298 are illustrated in FIG. 19. It is to be understood that variant 320 may have six blades, as depicted in FIG. 18, four blades as depicted in FIG. 19 or a different number of blades, depending upon a number of factors. Attachment devices 342 are illustrated to interconnect blades 298 with the bottom of casing 294. Attachment is accomplished by screws 344 securing a blade to an attachment device and screws 346 securing the attachment device to the casing.

Figure 20A:
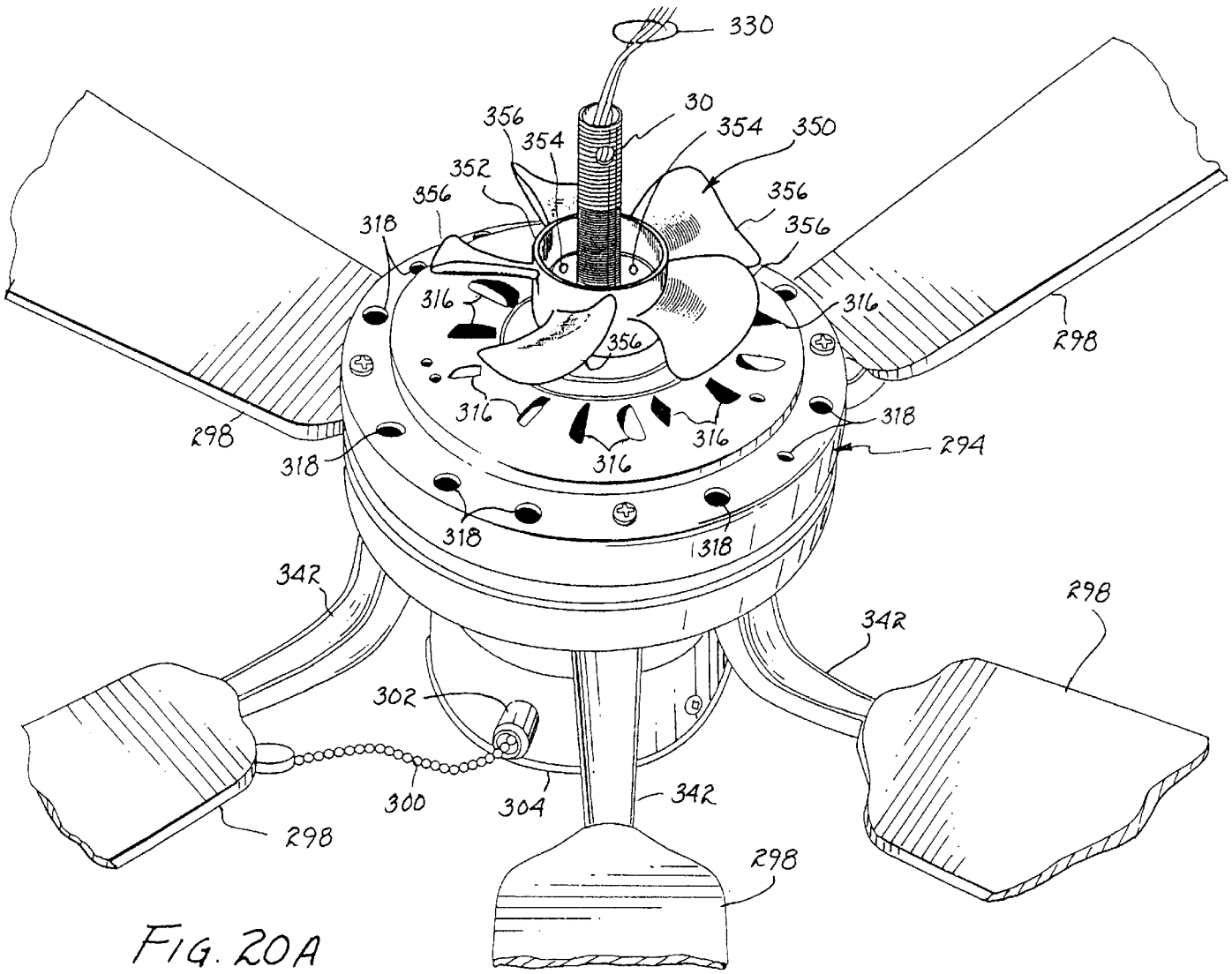
FIGS. 20A and 20B illustrate variants of a casing mounted secondary fan for drawing air through the casing and injecting it through a heating element.

FIG. 20A illustrates a secondary fan 350 of different structural configuration than fan 308 depicted in FIGS. 17, 18, and 19. This fan includes a cylindrical cup shaped hub 352 attached to casing 294 by screws 354 or the like. Each blade 356 extends from the hub to cause upward or downward air flow as a function of the direction of rotation.

Figure 20B:
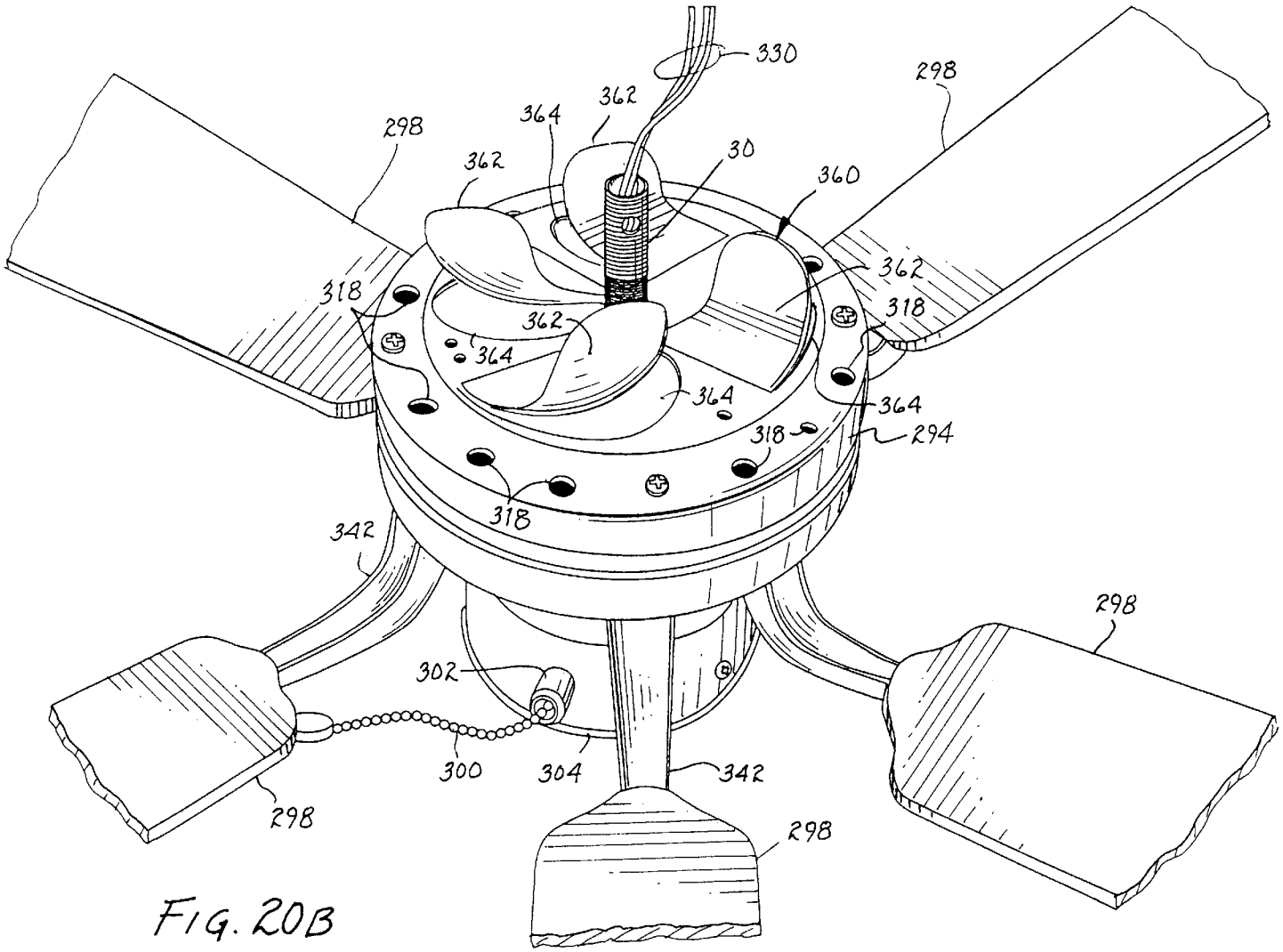

FIG. 20B illustrates a further variant of the secondary fan attached to casing 294. Fan 360 includes a plurality of blades 362 formed from partially severed sections of the upper surface of casing 294. These blades are bent upwardly to cause upward air flow upon clockwise rotation of casing 294 and downward air flow upon counterclockwise rotation of the casing. Upon bending blades 362 upwardly, apertures 364 are formed in the casing, which apertures permit air flow into or out of the casing.

Upon operation of variant 320 of the room conditioner to cause blades 298 to produce an upward air flow, the secondary fan, whether it be fan 308, 350 or 360, will cause an upward air flow. The upward air flow from the secondary fan will exhaust the air through apertures 336 in the top of housing 334. To accomplish this air flow, air will be drawn through the interior of heating element 180 causing such air flow to be heated. The exhausted heated air flow will mix with the surrounding upward air flow caused by set of blades 296 (298). The mixed warmed air flow will be distributed throughout the room wherein the room conditioner is located. Additionally, with suitable apertures disposed in the bottom of casing 294, air will be drawn through the motor within the casing from the bottom to the top and such air flow will have a cooling effect upon the motor; air exhaustion from the casing may be through apertures 318.

Figure 21:
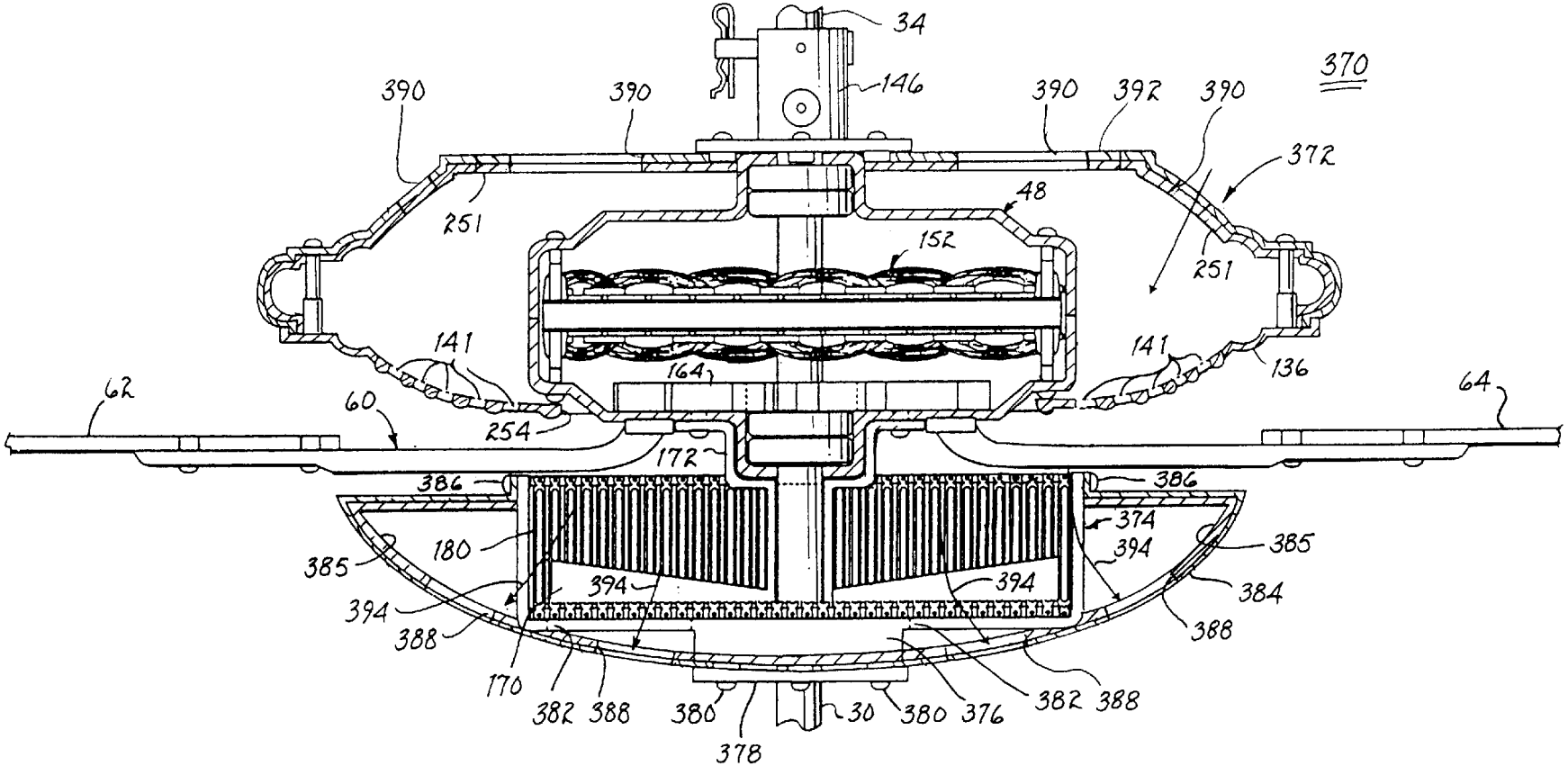
FIG. 21 illustrates a room conditioner having a heater mounted below the housing.

FIG. 21 illustrates a variant 370 of a room conditioner. Housing 372 of this variant is similar to housing 242 of variant 240 shown in FIG. 15 except that the housing has embodied therein primarily only casing 48 and its included motor 152. A lining 251 (see also FIG. 15) may be disposed on the interior of all or part of housing 372 to permit any type of material to be used for the housing. However, the casing and its components therewithin and attached thereto are turned essentially upside down. A cylindrical cap 374 has its open end extending upwardly. Base 376 of the cap is secured to a downward extension of shaft 30 by a plate 378 secured to the shaft in any manner well known to those skilled in the art. Bolts 380, or the like, secure the plate with the base. Base 376 of cap 374 includes a plurality of apertures 382. A heating element 180, of the type described above, is disposed within cap 374 and secured to base 376 in the manner described above. A secondary fan, such as fan 170, is secured to support 172 extending from casing 48 to locate the fan proximate the lower end of heating element 180. A decorative shroud 384 in the form of a bowl encloses the cylindrical cap. A lining 385 of thermally insulative material may be used adjacent shroud 384 to prevent migration of heat to the shroud and to permit a wide spectrum of materials for the shroud. The shroud may be attached to the cap by screws 386. The shroud includes a plurality of apertures 388. A plurality of apertures 390 may be disposed in upper housing 392 of housing 372.

In operation, upon rotation of set of blades 60, of which blades 62, 64 are shown, to cause downward movement of air, secondary fan 170 will rotate in the same direction in response to rotation of casing 48. Rotation of the secondary fan will exhaust air from within heating element 180, as depicted by arrows 394. Air intermediate housing 372 and heating element 180 will be drawn into the heating element as a result of the below ambient pressure present therein. This air may flow radially inwardly from in between housing 372 and shroud 384. Furthermore, the air may be drawn into housing 372 through apertures 390 thereof and be exhausted through apertures 141 at the bottom of the housing. Furthermore, a certain quantity of air may be drawn through the annular space intermediate edge 254 of lower housing 136 and casing 48. Any and all of this air flow through housing 372 will have a cooling effect upon casing 48 resulting in cooling of motor 152. As discussed above, fan 164 within casing 48 will circulate the air therewithin and cause transfer of heat from the motor to the casing; it will also serve as a heat sink to transfer heat to the casing. The casing is cooled by the air flow through housing 372.

Variant 370 of the room conditioner is particularly useful when a downward flow of heated air is desired. Not only is the heated air mixed with the air within the room, but the flow of air through the variant will maintain the motor cool and prevent a heat buildup due to any heat rising from heating element 180 to casing 48.

Figure 22:
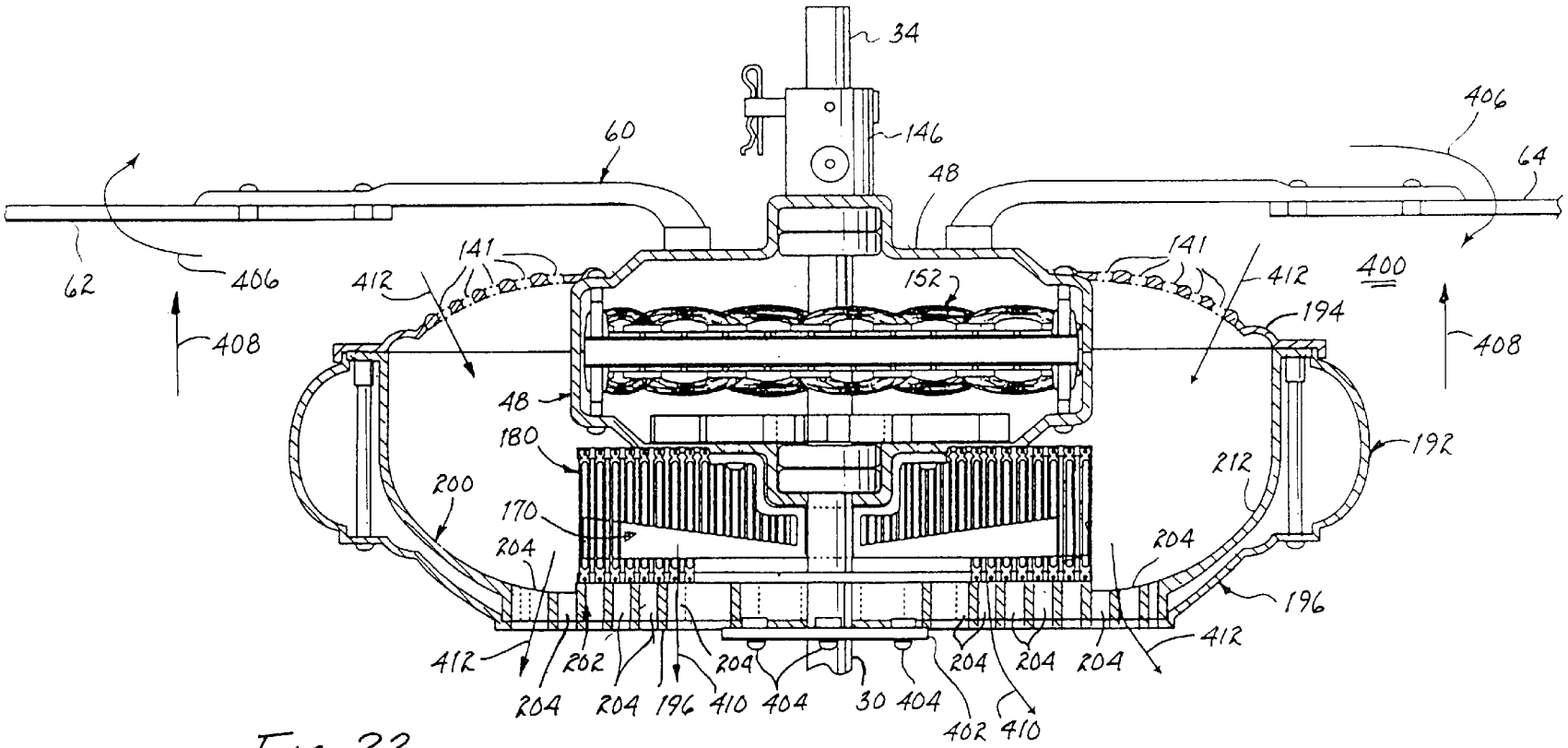
FIG. 22 illustrates a room conditioner shown in FIG. 10 but turned upside down.

Referring to FIG. 22 there is shown a variant 400 of a room conditioner. This variant is essentially duplicative of variant 190 illustrated in FIG. 10 except that it is mounted upside down with respect thereto. Accordingly, common reference numerals will be used for common elements. Casing 48 may be attached to fixture 146 in a conventional manner well known to those skilled in the art. Alternatively, a plate 402, secured to formerly upper housing 196 of housing 192 may be employed through use of screws 404 or bolts. The plate is in turn pinned or otherwise secured to shaft 30.

In operation, upon energization of motor 152, casing 40 will rotate causing rotation of set of blades 60, of which blades 62, 64 are shown, in the direction indicated by arrows 406. Secondary fan 170 will rotate commensurately therewith due to its mechanical engagement with casing 48. Assuming that such rotation of set of blades 60 will produce an upward flow of air, as depicted by arrows 408, a downward flow of air resulting from operation of secondary fan 70 will occur, as depicted by arrows 410. The downward flow of air caused by the secondary fan will create a low pressure environment within housing 192. In response thereto, air will be drawn into the housing through apertures 141, as depicted by arrows 412. Air entering the housing will flow in and about heating element 180 and be exhausted therefrom through apertures or arcs 204 in platform 202. The air flow external of heating element 180 will exhaust through the platform, as depicted by arrows 412. The air flowing in and about heating element 180 will be warmed. Similarly, the air flowing adjacent but external to the heating element will be warned by radiant heat emanating from the heating element. This warmed air, represented by arrows 410, 412, will mix with the upflowing air (depicted by arrows 408) resulting from operation of set of blades 60. The warmed mixed air will be circulated throughout a room on an ongoing basis to raise the temperature of a room to whatever level a thermostat controlling operation of the room conditioner is set.

Figure 23:
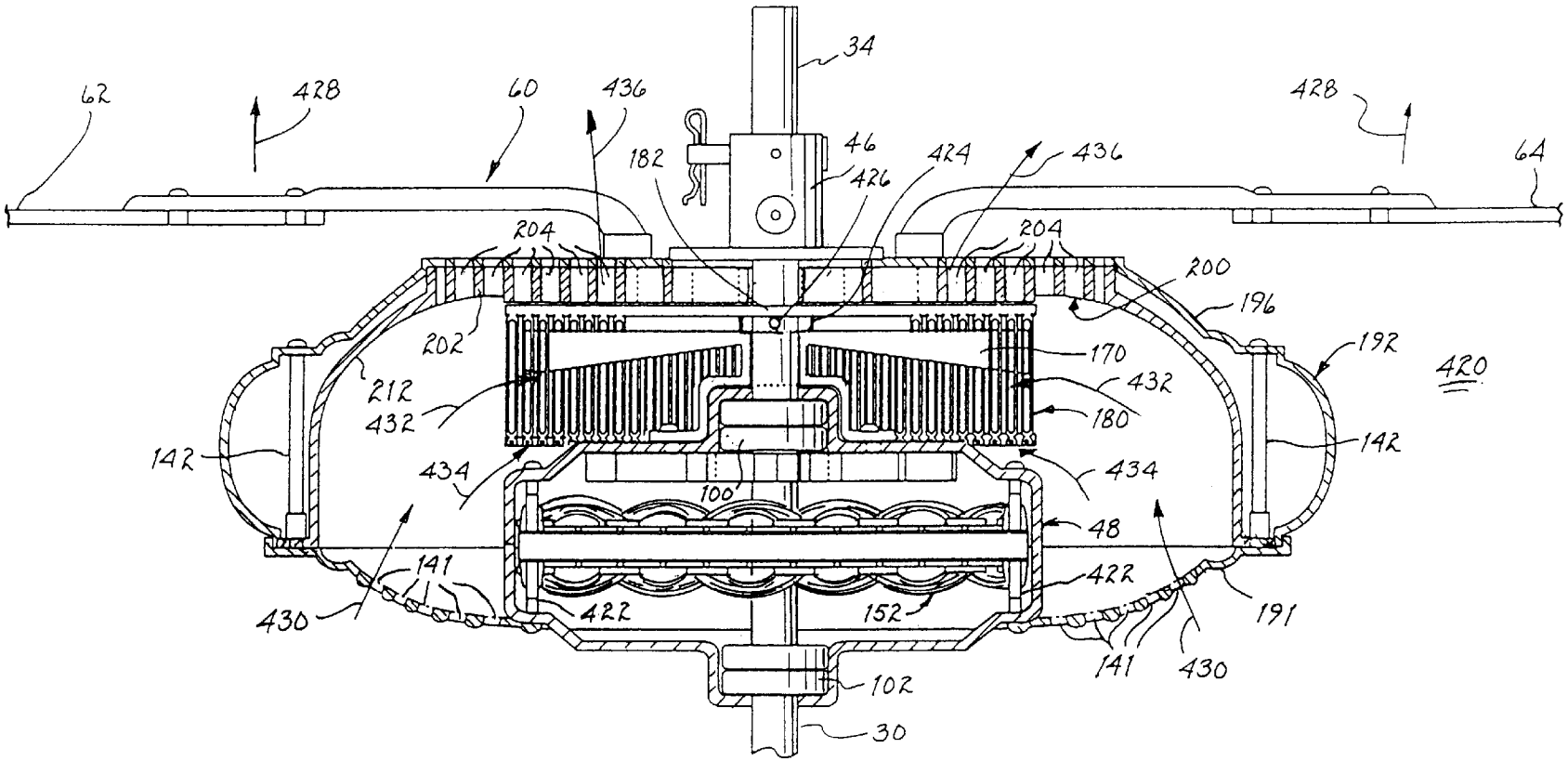
FIG. 23 illustrates a room conditioner shown in FIG. 10 having a set of blades mounted at the top of the housing.

Referring to FIG. 23, a variant 420 of the room conditioner is illustrated. This variant is very similar to variant 190 illustrated in FIG. 10 except for one difference. In the description below, common reference numerals will be used for like elements. The major difference between the two variants is that set of blades 60, of which only blades 62, 64 are shown, are attached to upper housing 196 of housing 192 and adjacent internal shroud 200. To effect rotation of the set of blades, housing 192 must rotate. This precludes securing the housing to shaft 30; and, the heating element may not rotate. To retain heating element 180 in fixed non-rotating relationship to secondary fan 170, hub 182 (see FIG. 9) may include a collar 424 supporting a set screw 426 for securing the collar to non-rotating shaft 30 and thereby prevent rotation of the heating element. To rotate housing 192 to which set of blades 60 is attached, the housing must be attached to casing 48. Such attachment may be by use of bolts 422 interconnecting lower housing 194 with the casing. To retain the casing fixed along shaft 30, bearings 100,102 may be press fit or the interior race of one or more of the bearings may be pinned to the shaft.

In operation, motor 152 is energized to rotate set of blades 60 to cause an upward flow of air, as depicted by arrows 428. The commensurate rotation of secondary fan 170 will cause an upward flow of air from within heating element 180 and inwardly through the slots of the heating element. This air will be exhausted through apertures 204 of the internal shroud and the corresponding apertures in the upper housing. Air is drawn into housing 192 through apertures 141 in lower housing 194, as depicted by arrows 430. This air will flow through the side wall of heating element 180, as depicted by arrows 432 and into the interior of the heating element between casing 48 and the heating element, as depicted by arrows 434.

The air flow through housing 192 has two benefits. First, the air flow around and about casing 48 will tend to cool the casing and prevent heat buildup in motor 152. Secondly, the air flowing into and out of the housing will be heated by the heating element and exhausted upwardly, as depicted by arrows 436. The heated air will mix with the air flow depicted by arrows 428 caused by set of blades 60 and become dispersed throughout the room wherein variant 420 of the room conditioner is located.

Figure 24:
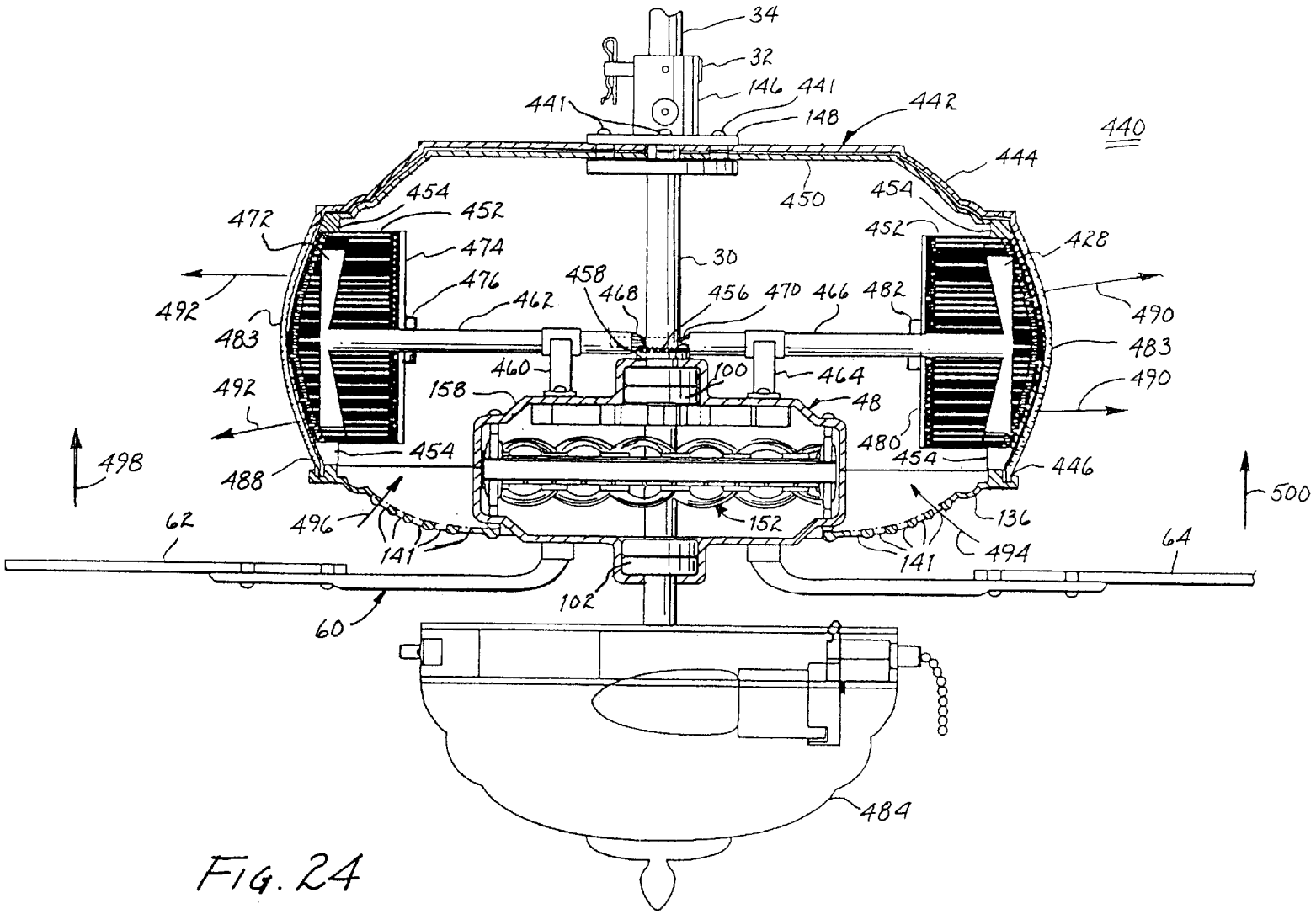
FIG. 24 illustrates a room conditioner having laterally disposed heating elements.

Referring to FIG. 24, there is shown a variant 440 of a room conditioner having side mounted heating elements for injecting heat into the air flow resulting from operation of a set of blades 60, of which blades 62, 64 are shown. Elements of this variant common to previously described room conditioners will have common reference numerals. A housing 442 is attached to an inner shroud 450 by a plate 148 and secure attachment means, such as bolts 441. The housing plate and inner shroud are apertured to clear shaft 30. A collar 443 may be secured by bolts 441 for structural reasons; the collar may include a bearing to rotatably engage shaft 30. Housing 442 includes an upper housing 444 and a lower housing 136, which lower housing is similar to the lower housings previously described. Lower edge 446 of upper housing 144 rests within a channel 448 formed at the perimeter of lower housing 136. Since the only force exerted upon lower housing 136 and this junction is the weight of the lower housing, the junction may be a snap fit. Alternatively, fastening means, such as screws, may be employed. Upper housing 444 includes a plurality of apertures 483 disposed proximate each of heating elements 452 which apertures permit egress of heated air from within housing 442. Internal shroud 450 may extend along and be attached to upper housing 444 at several locations. The internal shroud is attached to and supports one or more heating elements 452, which heating elements may be of the type described above and identified by reference numeral 180. A means for attachment between the internal shroud and the heating elements may be a collar 454 surrounding in a griping relationship each heating element. Preferably, shroud 450 is of thermally insulative material to prevent heat migration to housing 442 and thereby permit a wide range of materials for the housing to satisfy aesthetic considerations. Casing 48 includes motor 152 and will rotate about shaft 30 as described above. A bevel gear 456 is mounted about shaft 30 at the upper end of casing 48; alternatively, this bevel gear may be formed as part of upper casing 158. A pillow block 460, extending upwardly from casing 48, journals shaft 462. A similar pillow block 464 also extends upwardly from casing 48 to rotatably support shaft 466. The end of shaft 462 proximate shaft 30 includes a bevel gear 468 for engagement with bevel gear 456. Similarly, shaft 466 includes a bevel gear 470 for engagement with bevel gear 456. Shaft 462 supports a secondary fan 472. Shaft 462 is located centrally of heating element 452 by use of a support structure 474, which may be similar in configuration to support structure 182 shown in FIG. 9. However, a collar with an incorporated bearing 476 may be attached to the support structure 474 to journal shaft 462 therein. Similarly, fan 478 is disposed at the end of shaft 466. A support structure 480, like support structure 182 shown in FIG. 9, is attached to heating element 452. A collar 482 and bearing incorporated therein rotatably secures heating element 452 with shaft 466. To ensure non-movement of casing 48 along shaft 30, bearings 100, 102 may be pinned or otherwise secured to shaft 30.

A light fixture 482 may be dependingly supported from the end of shaft 30. This light fixture is similar in structure and operation to light fixture 272 shown and described with respect to FIG. 16. Accordingly, further details of light fixture 484 need not be reviewed.

Rotation of set of blades 60 upon energization of motor 152 will cause casing 48 to rotate about shaft 30 along with shafts 462, 466, internal shroud 450 and housing 442. The resulting rotation of bevel gears 468, 470 due to translation along bevel gear 456 will cause commensurate rotation of shafts 462 and 466, respectively. The rotation of these shafts will result in rotation of secondary fans 472, 478. Assuming that rotation of secondary fans 472, 478 will induce an outward flow of air through apertures 483 in upper housing 444, the resulting air flow is depicted by arrows 490, 492. The resulting low pressure environment within housing 442 will result in an inflow of air, as depicted by arrows 494, 496 through apertures 141 in lower housing 136. The inflowing air will tend to cool casing 48. Furthermore, the inflow of air will flow through the side walls of heating elements 452 and through the center thereof. Such air flow past the heating elements will warm the air and the air expelled from housing 442 will be warmed. This warm air will mix with the upwardly flowing air produced by operation of set of blades 60, as depicted by arrows 498, 500. The resultant mixture of warmed air will be dispersed throughout the room in which variant 440 of the room conditioner is located.

Figure 25:
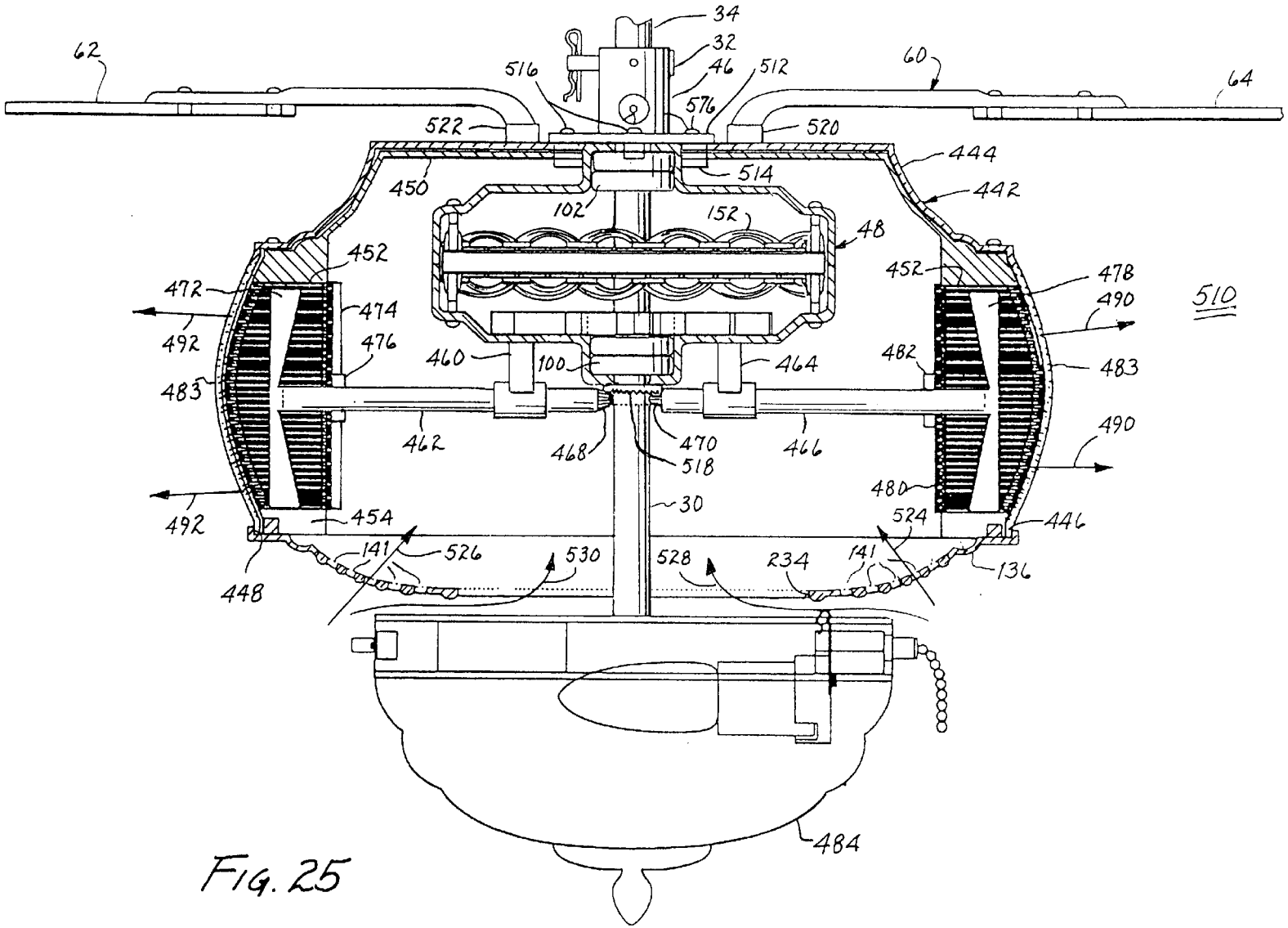
FIG. 25 illustrates a variant of the room conditioner shown in FIG. 24.

Referring to FIG. 25, there is illustrated variant 510 of a room conditioner. This variant is very similar to variant 440 shown in FIG. 24 except that set of blades 60, of which blades 62, 64, are shown, are located at the top and affixed to housing 442. Accordingly, only the differences between these two variants will be described in detail. Elements common to both variants will be assigned common reference numerals. Casing 48 is rotatably mounted upon shaft 30 by bearings 100, 102; other retention means well known to those skilled in the art may also be employed. Housing 442 includes upper housing 444 and lower housing 136. Internal shroud 450, as described above, supports heating elements 452 and may be of thermally insulative material, as also discussed above. A plate 512 interconnects upper housing 444 with internal shroud 450 with casing 48 through a collar 514, or the like. Bolts or screws 516 may be employed for this purpose. Thereby, upon rotation of casing 48 in response to energization of motor 152, housing 442 and internal shroud 450 will rotate. Such rotation will result in transport of shafts 462, 466 about shaft 30. Bevel gear 518 fixedly attached to shaft 30, will mesh with bevel gears 468, 470. The transport of shafts 462, 466 about shaft 30 will result in bevel gear 518 imparting rotational movement to bevel gears 468, 470 and shafts 462, 466 will rotate. Such rotation will result in rotation of secondary fans 472, 478, as described above and produce flow of heated air through apertures 483, as depicted by arrows 490, 492. Set of blades 60 are attached to housing 442 by fixtures 520, 522. Such attachment produces commensurate rotation of the set of blades with rotation of housing 442. If blades 62, 64 cause upward movement of air, the heated flow of air emanating from apertures 483 will be drawn upwardly and mix with the air flow generated by set of blades 60. Such mixing of the warmed air with the ambient air will raise the temperature of the ambient air within the room or enclosure wherein variant 510 of the room conditioner is located. Alternatively, set of blades 60 of variant 440 (FIG. 24) and variant 510 may cause downward movement of air flow. In such case, the warmed air emanating through apertures 483 will be mixed with the downwardly flowing air and result in warmed air permeating the enclosure wherein variant 510 is located. As noted with respect to FIG. 24, air flowing into housing 442 for discharge through apertures 483 enters through apertures 141, as depicted by arrows 524, 526. In addition, the center bottom, defined by circular edge 234, provides a space through which air may enter housing 442, as depicted by arrows 528, 530. A light fixture 484 may be incorporated, as described above.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

I claim:

1. A room conditioner for heating a room, said room conditioner comprising in combination, the following components:

a) at least one support, adapted to an upward location;

b) at least one motor surrounded by at least one casing, said at least one casing rotationally responsive to rotation of said at least one motor;

c) at least one fan blade adapted to said at least one casing for creating a first upward airflow;

d) at least one independent heating unit isolated from said at least one motor, said at least one independent heating unit comprised of:

1. at least one heating element; and
2. at least one secondary fan blade rotationally responsive to rotation of said at least one motor for urging a flow of air past said at least one heating element for mixing with said first upward airflow.

2. The room conditioner as set forth in claim 1 wherein said at least one fan blade and said at least one secondary fan blade have a common axis of rotation and wherein said at least one secondary fan blade is disposed axially above said at least one fan blade.

3. The room conditioner as set forth in claim 1 wherein said at least one fan blade and said at least one secondary fan blade have a common axis of rotation and wherein said at least one secondary fan blade is disposed axially below said at least one fan blade.

4. The room conditioner as set forth in claim 1 wherein said at least one heating element comprises a permeable wall.

5. The room conditioner as set forth in claim 1 wherein said at least one heating element comprises a solid surface for air to flow therepast.

6. The room conditioner as set forth in claim 1 including at least one housing for enclosing at least one component, said at least one housing including at least one outlet for egress of the heated air from said at least one heating element.

7. The room conditioner as set forth in claim 6 wherein said at least one housing includes at least one inlet for ingress of airflow in response to said at least one secondary fan blade.

8. The room conditioner as set forth in claim 1 including at least one light supported from said room conditioner.

9. The room conditioner as set forth in claim 1 wherein said at least one casing surrounding said at least one motor has radial flanges disposed within said at least one casing for generating a further airflow to cool said at least one motor.

10. A room conditioner for heating a room, said room conditioner comprising in combination, the following components:

a) at least one support, adapted to a fixture;

b) at least one motor surrounded by at least one casing, said at least one casing rotationally responsive to rotation of said at least one motor and having at least one fan blade adapted thereto to produce a first upward airflow;

c) at least one independent heating unit isolated from said at least one motor, said at least one independent heating unit comprised of:

1. at least one heating element; and 2. at least one secondary fan blade responsive to rotation of said at least one motor for urging a second airflow past said at least one heating element to heat said second flow of air; and d) a means for discharging the heated said second airflow to mix with said first upward airflow.

11. The room conditioner as set forth in claim 10 wherein said at least one fan blade and said at least one secondary fan blade have a common axis of rotation and wherein said at least one secondary fan blade is disposed axially above said at least one fan blade.

12. The room conditioner as set forth in claim 10 wherein said at least one fan blade and said at least one secondary fan blade have a common axis of rotation and wherein said at least one secondary fan blade is disposed axially below said at least one fan blade.

13. The room conditioner as set forth in claim 10 wherein said room conditioner has a heat sink barrier for reducing transfer of heat between said at least one heating element and said at least one motor.

14. The room conditioner as set forth in claim 10 wherein said at least one secondary fan blade is adapted to rotate with said at least one motor.

15. The room conditioner as set forth in claim 14 wherein said at least one secondary fan blade is diposed optionally either exteriorly or interiorly of said at least one heating element.

16. The room conditioner as set forth in claim 10 including at least one housing for enclosing at least one component.

17. The room conditioner as set forth in claim 16, wherein said discharging means includes at least one inlet and at least one outlet for accommodating said second airflow into and out of said at least one housing.

18. The room conditioner as set forth in claim 16 including means for urging a further flow of air through said at least one motor.

19. The room conditioner as set forth in claim 10, wherein said at least one heating element is downstream in the second airflow from said at least one motor to minimize heating of said at least one motor by said at least one heating element.

20. The room conditioner as set forth in claim 10, wherein said at least one secondary fan blade is formed by the material of said at least one casing.

21. A room conditioner for heating a room, said room conditioner comprising in combination, the following components:

a) an air distribution device having at least one motor, said at least one motor surrounded by at least one casing, said at least one casing rotationally responsive to rotation of said at least one motor and having at least one fan blade adapted thereto for creating a first upward airflow;

b) at least one independent heating unit isolated from said at least one motor, said at least one independent heating unit comprised of:

1. at least one heating element; and 2. at least one secondary fan blade for conveying a second airflow to mix with said first upward airflow and proximate said at least one heating element to heat said second airflow; and c) means for discharging said second airflow from said room conditioner with said first upward airflow to mix said second airflow with said first upward airflow.

22. The room conditioner as set forth in claim 21 wherein said at least one fan blade and said at least one secondary fan blade have a common axis of rotation and wherein said at least one secondary fan blade is disposed axially above said at least one fan blade.

23. The room conditioner as set forth in claim 21 wherein said at least one fan blade and said at least one secondary fan blade have a common axis of rotation and wherein said at least one secondary fan blade is disposed axially below said at least one fan blade.

24. The room conditioner as set forth in claim 21 wherein said at least one secondary fan blade is located upwards of said air distribution device.

25. The room conditioner as set forth in claim 21 wherein said at least one motor of said air distribution device includes at least one secondary fan blade adapted to rotate with said at least one motor.

26. The room conditioner as set forth in claim 21, wherein said room conditioner includes at least one housing for enclosing at least one component.

27. The room conditioner as set forth in claim 26 wherein said at least one housing includes at least one inlet and at least one outlet for accommodating airflow into and out of said at least one housing in response to said at least one secondary fan blade.

28. The room conditioner as set forth in claim 21 wherein said discharging means includes at least one outlet.

29. The room conditioner as set forth in claim 21 wherein said at least one heating element is isolated from said at least one motor to prevent overheating of said at least one motor.

30. A room conditioner for optionally heating or cooling a room, comprising in combination, the following components:

a) at least one support, adapted to an upward location;

b) at least one motor surrounded by at least one casing, said at least one casing rotationally responsive to the rotation of said at least one motor and having at least one fan blade adapted thereto to produce optionally an upward airflow for heating or a downward airflow for cooling;

c) at least one secondary fan blade and at least one heating element, isolated from said at least one motor, for heating a second airflow for mixing with said upward airflow for heating; and d) at least one means for optionally selecting the direction of rotation of said at least one motor to create either an upward or downward flow of air.

31. The room conditioner as set forth in claim 30 wherein said at least one fan blade and said at least one secondary fan blade have a common axis of rotation and wherein said at least one secondary fan blade is disposed axially above said at least one fan blade.

32. The room conditioner as set forth in claim 30 wherein said at least one fan blade and said at least one secondary fan blade have a common axis of rotation and wherein said at least one secondary fan blade is disposed axially below said at least one fan blade.

33. The room conditioner as set forth in claim 30 wherein said room conditioner incorporates a heat sink barrier to protect at least one component from the transfer of heat.

34. A method for heating a room with a room conditioner, said method comprising the steps of:

a) producing a first upward airflow with at least one fan blade of an air distribution device, said upward airflow flowing first across the ceiling, then down the walls, then across the floor, then back into re-circulation, said at least one fan blade adapted to at least one casing, said at least one casing surrounding at least one motor and rotational responsive thereto;

b) generating a second airflow with at least one secondary fan blade for mixing with said first upward airflow, said at least one secondary fan blade isolated from aid at least one motor; and c) heating said second airflow with at least one heating device of said room conditioner prior to mixing with said first upward airflow to elevate the temperature of said first upward airflow, said at least one heating device isolated from said at least one motor.

35. The method as set forth in claim 34 wherein said step of generating mixes the second airflow with the first upward airflow downstream of the at least one fan blade.

36. he method as set forth in claim 34 wherein said step of generating is performed in response to rotation of at least one fan blade of the air distribution device.

37. The method as set forth in claim 34, wherein at least one of the following components: said at least one motor, said at least one heating device and said at least one secondary fan blade include the step of urging said second airflow into and out of said at least one heating device.

38. The method as set forth in claim 37 including the step of protecting said at least one motor from the transfer of heat through the use of a heat sink barrier.

39. The method as set forth in claim 38 including the step of inducing a flow of air into and out of at least one inlet and at least one outlet in said at least one heating device by executing said step of generating.

40. A room conditioner for uniformly heating a room, said room conditioner comprising in combination, the following components:

a) at least one support, adapted to an upward location;

b) at least one motor surrounded by at least one casing, said at least one casing rotationally responsive to rotation of said at least one motor and having at least one fan blade adapted thereto to produce a first upward airflow;

c) at least one independent heating unit isolated from said at least one motor, said at least one independent heating unit comprised of:

1. at least one heating element; and
2. at least one secondary fan blade rotatably associated with each of said at least one heating element for urging a second airflow past each of said at least one heating element to warm said second airflow;

d) a means for rotating each of said at least one secondary fan blade by adapting said means to said at least one motor;

e) means for interconnecting each of said at least one fan blade to said at least one casing for rotating each of said at least one fan blade upon rotation of said at least one motor to urge rotation of the attached said at least one secondary fan; and f) means for mixing the warmed said second airflow with said first upward airflow to raise the temperature of the air in the room.

41. The room conditioner as set forth in claim 40 wherein said at least one fan blade and said at least one secondary fan blade have a common axis of rotation and wherein said at least one secondary fan blade is disposed axially above said at least one fan blade.

42. The room conditioner as set forth in claim 40 wherein said at least one fan blade and said at least one secondary fan blade have a common axis of rotation aid wherein said at least one secondary fan blade is disposed axially below said at least one fan blade.

43. The room conditioner as set forth in claim 40 including at least one housing for enclosing at least one component, said at least one housing including at least one outlet for exhausting the warmed second airflow into the first upward airflow.

44. An air distribution device assembly, comprising:

a) at least one support, adapted to and upward location;

b) at least one motor surrounded by at least one casing, said at least one casing rotationally responsive to the rotation of said at least one motor and having at least one main fan blade adapted thereto;

c) at least one secondary fan blade disposed upward of said at least one main fan blade and isolated from said at least one motor;

d) at least one heating element disposed to occupy a position in use above said at least one motor but spaced below the ceiling and isolated from said at least one motor; and e) said at least one secondary fan blade being disposed to create a flow of air though said at least one heating element.

45. The air distribution device assembly as set forth in claim 44 wherein said at least one secondary fan blade is disposed above said at least one heating element to draw air through said at least one heating element.

46. The air distribution device assembly as set forth in claim 44 wherein said at least one secondary fan blade is rotatably driven by said at least one motor.

47. The air distribution device assembly as set forth in claim 44, wherein said at least one secondary fan blade is formed on said at least one casing.

48. The air distribution device assembly as set forth in claim 44, wherein said at least one main fan blade extends outwardly beyond said at least one motor and said at least one casing, said at least one secondary fan blade being shorter than said at least one main fan blade, and said at least one secondary fan blade disposed above said ate least one motor.

49. he air distribution device assembly as set forth in claim 44 further comprising an outer cover, said at least one motor, at least one heating element and at least one secondary fan blade being disposed inside said cover, and said at least one main fan blade being disposed optionally inside or outside said cover.

50. An air distribution device assembly, comprising:

a) at least one support;

b) at least one motor adapted to said support, said at least one motor surrounded by at least one casing, said at least one casing rotationally responsive to the rotation of said at least one motor;

c) at least one main air moving fan blade adapted to said at least one casing and rotationally responsive to the rotation of said at least one casing rotatably driven by said at least one motor;

d) at least one secondary fan blade isolated from and rotatably driven by said at least one motor; and e) at least one heating element isolated from said at least one motor.

51. The air distribution device assembly as set forth in claim 50 wherein said at least one main air moving fan blade and said at least one secondary fan blade have a common axis of rotation and wherein said at least one secondary fan blade is disposed axially above said at least one main air moving fan blade.

52. The air distribution device assembly as set forth in claim 50 wherein said at least one main air moving fan blade and said at least one secondary fan blade have a common axis of rotation and wherein said at least one secondary fan blade is disposed axially below said at least one main air moving fan blade.

53. an air distribution device assembly, comprising:

a) at least one structure suspending said air distribution device assembly from an upward location of a room;

b) at least one main fan blade rotatable in opposite directions for directing air upwardly or downwardly, said at least one fan blade adapted to at least one casing, said at least one casing surrounding at least one motor and rotationally responsive thereto;

c) at least one heater isolated from said at least one motor;

d) at least one secondary fan blade isolated from said at least one motor and rotatable to create an upward flow of air past said at least one heater; and e) a cooling airflow resulting when said at least one main fan blade is directing air downwardly.

54. The air distribution device assembly as set forth in claim 53 wherein said at least one main fan blade and said at least one secondary fan blade have a common axis of rotation and wherein said at least one secondary fan blade is disposed axially above said at least one main fan blade.

55. The air distribution device assembly as set forth in claim 54, wherein:

a) said at least one main fan blade includes at least one electric motor;

b) said at least one heater and said at least one secondary fan blade are disposed above said at least one motor and isolated therefrom; and c) said cooling airflow is disposed below said at least one air distribution device.

56. The air distribution device assembly as set forth in claim 54, wherein said cooling airflow is generated by at least one outwardly extending blade.

57. A method of heating and cooling a room having a ceiling and walls, comprising:

a) for heating, the steps of employing an air distribution device to direct a main stream of room air upwardly against the ceiling and then across the ceiling outwardly towards the walls, employing at least one secondary fan blade and a heater associated therewith to direct a smaller stream of heated air to effect intermingling of the main stream, air adjacent the ceiling and the smaller stream as the streams pass across the ceiling towards the walls, said at least one secondary fan blade and said heater isolated from at least one motor, said motor being the rotational force that drives said at least one secondary fan blade; and b) for cooling, employing said air distribution device to direct air from adjacent the ceiling downwardly into the room.

* * * * *